US008333667B2

(12) United States Patent
Kumamoto et al.

(10) Patent No.: US 8,333,667 B2
(45) Date of Patent: Dec. 18, 2012

(54) GOLF CLUB HEAD

(75) Inventors: Tomio Kumamoto, Kobe (JP); Kiyofumi Matsunaga, Kobe (JP)

(73) Assignee: SRI Sports Limited, Kobe-Shi (JP)

( * ) Notice: Subject to any disclaimer, the term of this patent is extended or adjusted under 35 U.S.C. 154(b) by 469 days.

(21) Appl. No.: 12/559,105

(22) Filed: Sep. 14, 2009

(65) Prior Publication Data

US 2010/0137072 A1 Jun. 3, 2010

(30) Foreign Application Priority Data

Dec. 3, 2008 (JP) ..... 2008-308083
Dec. 26, 2008 (JP) ..... 2008-333596

(51) Int. Cl.
*A63B 53/04* (2006.01)

(52) U.S. Cl. ..... 473/342

(58) Field of Classification Search ..... 473/324–350
See application file for complete search history.

(56) References Cited

U.S. PATENT DOCUMENTS 4,928,972 A * 5/1990 Nakanishi et al. ..... 473/332
5,316,298 A * 5/1994 Hutin et al. ..... 473/332
5,409,229 A * 4/1995 Schmidt et al. ..... 473/332
5,586,947 A * 12/1996 Hutin ..... 473/324
5,588,923 A * 12/1996 Schmidt et al. ..... 473/340
5,605,511 A * 2/1997 Schmidt et al. ..... 473/324
5,626,530 A * 5/1997 Schmidt et al. ..... 473/324
5,704,849 A 1/1998 Schmidt et al.
5,738,596 A 4/1998 Meyer
6,344,252 B1 * 2/2002 Werner ..... 428/40.1
6,592,469 B2 * 7/2003 Gilbert ..... 473/350
6,602,150 B1 * 8/2003 Kosmatka ..... 473/342
6,695,712 B1 * 2/2004 Iwata et al. ..... 473/291
6,860,819 B2 * 3/2005 Gilbert ..... 473/291
7,387,579 B2 * 6/2008 Lin et al. ..... 473/332
7,819,757 B2 * 10/2010 Soracco et al. ..... 473/332

(Continued)

FOREIGN PATENT DOCUMENTS

JP 9-666 A 1/1997

(Continued)

OTHER PUBLICATIONS

Japanese Office Action for Application No. 2008-308083 dated Apr. 19, 2011.

(Continued)

*Primary Examiner* — Alvin Hunter
(74) *Attorney, Agent, or Firm* — Birch Stewart Kolasch & Birch, LLP

(57) ABSTRACT

A golf club head 2*a* of a first aspect is provided with a head body h1*a*, a double-stick tape w1, and an adherend s1*a* bonded to the head body h1*a* by the double-stick tape w1. When an average thickness of a lower part of the adherend s1*a* is defined as f1 and an average thickness of an upper part of the adherend s1*a* is defined as f2, the thickness f2 is smaller than the thickness f1. A golf club head 2 according to a second aspect is provided with a head body h1, a double-stick tape w1 and an adherend s1 bonded to the head body h1 by the double-stick tape w1. When an average thickness of a heel part of the adherend s1 is defined as t1 and an average thickness of a toe part of the adherend s1 is defined as t2, the thickness t2 is smaller than the thickness t1.

26 Claims, 19 Drawing Sheets

U.S. PATENT DOCUMENTS

| | | | | |
|---|---|---|---|---|
| 7,892,106 | B2 * | 2/2011 | Matsunaga | 473/290 |
| 7,922,604 | B2 * | 4/2011 | Roach et al. | 473/350 |
| 7,927,697 | B2 * | 4/2011 | Nonaka et al. | 428/355 AC |
| 2002/0098910 | A1 | 7/2002 | Gilbert | |

FOREIGN PATENT DOCUMENTS

| | | | | |
|---|---|---|---|---|
| JP | 9-308712 | A | | 12/1997 |
| JP | 2792642 | B2 | | 9/1998 |
| JP | 2000-73028 | A | | 3/2000 |
| JP | 3071937 | U | | 7/2000 |
| JP | 2000319614 | A | * | 11/2000 |
| JP | 2002-224255 | A | | 8/2002 |
| JP | 2003020459 | A | * | 1/2003 |
| JP | 2003-284794 | A | | 10/2003 |
| JP | 2006-206621 | A | | 8/2006 |
| JP | 2008-125811 | A | | 6/2008 |
| JP | 2011016943 | A | * | 1/2011 |
| WO | WO 2009048233 | A1 | * | 4/2009 |

OTHER PUBLICATIONS

Japanese Office Action for Application No. 2008-333596 dated Apr. 19, 2011.

* cited by examiner

GOLF CLUB HEAD

The present application claims priorities on Japanese Patent Applications Nos. 2008-308083 filed on Dec. 3, 2008, and 2008-333596 filed on Dec. 26, 2008. The whole contents of the Japanese Patent Applications are hereby incorporated by reference.

BACKGROUND OF THE INVENTION

1. Field of the Invention

The present invention relates to a golf club head.

2. Description of the Related Art

An adherend such as a weight member, a vibration absorbing member and a batch is sometimes attached to a golf club head. A double-stick tape is used for the attachment. The double-stick tape has a front surface and a reverse surface which have adhesiveness. Generally, the double-stick tape is referred to as a double-sided tape in Japan.

Japanese Patent Publication No. 2792642 (U.S. Pat. No. 5,409,229) discloses a golf club head having a face and a thin plate stuck on the back surface of the face by a double-stick tape. The double-stick tape has a tape base material and adhesive layers provided on both surfaces thereof.

SUMMARY OF THE INVENTION

A strong impact shock acts on a golf club head at the time of hitting a ball. The adherend bonded due to the double-stick tape may be separated due to the impact shock. The prevention of the separation has been required.

On the other hand, the adherend can have a vibration absorbing effect. The adherend can suppress uncomfortable vibration at the time of hitting the ball.

A head body may be deformed by the strong impact shock at the time of hitting the ball. Since the adherend is likely to follow the deformation of the head body when the whole adherend is thin, the adherend is less easily separated. However, when the whole adherend is thin, the adherend is apt to be deformed in an attaching work. Therefore, in this case, the attaching workability and the attaching strength are apt to be reduced.

When the whole adherend is thin, a vibration absorbing effect is apt to be reduced.

On the other hand, when the whole adherend is thick, the adherend is less likely to follow the deformation of the head body. In this case, the separation of the adherend is apt to occur.

The present inventor considered the combination of the separation of the adherend and the vibration absorbing effect due to the adherend, and resulted in a first aspect of the present invention.

It is an object of a first aspect to provide a golf club head having an adherend less easily separated and having a high vibration absorbing effect.

A golf club head according to the first aspect of the present invention includes a head body; a double-stick tape; and an adherend bonded to the head body by the double-stick tape. The head body has a face surface and a back surface located on a back of the face surface. The adherend is bonded to the back surface. When an average thickness of a lower part of the adherend is defined as f1 and an average thickness of an upper part of the adherend is defined as f2, the thickness f2 is smaller than the thickness f1.

Preferably, an average thickness t2 of a toe part of the adherend is smaller than an average thickness t1 of a heel part of the adherend.

Preferably, a ratio (f1/f2) of the thickness f1 to the thickness f2 is 1.1 or greater and 5 or less.

Preferably, the double-stick tape includes a first adhesive layer, a second adhesive layer, and an intermediate layer provided between the first adhesive layer and the second adhesive layer. The intermediate layer includes a fiber layer.

Preferably, a thickness of the double-stick tape is 0.1 mm or greater and 0.4 mm or less.

Preferably, the fiber layer is a nonwoven fabric layer.

Preferably, the thickness f1 is 0.5 mm or greater 2.0 mm or less.

Preferably, the thickness f2 is 0.2 mm or greater and 1.5 mm or less.

Preferably, a height Hg of a gravity center of the head is 15 mm or greater and 30 mm or less.

Preferably, a minimum thickness $f1_{min}$ of a lower part of the adherend is equal to or greater than a maximum thickness $f2_{max}$ of an upper part of the adherend.

Preferably, when a maximum thickness of a lower part of the adherend is defined as $f1_{max}$, a straight line connecting a sweet spot and a gravity center of the head with each other crosses a portion with the thickness $f1_{max}$ of the adherend.

According to a first aspect, the difficult separation of the adherend and the vibration absorbing effect can be combined by making the thickness f2 of the upper part smaller than the thickness f1 of the lower part.

A golf club head according to a second aspect of the present invention includes a head body; and an adherend. The head body has a face surface and a back surface located on a back of the face surface. The adherend is bonded to the back surface. When an average thickness of a heel part of the adherend is defined as t1 and an average thickness of a toe part of the adherend is defined as t2, the thickness t2 is smaller than the thickness t1.

Preferably, a ratio (t1/t2) of the thickness t1 to the thickness t2 is 1.1 or greater and 5 or less.

Preferably, when the maximum thickness of the heel part of the adherend s1 is defined as $t1_{max}$; the minimum thickness of the heel part of the adherend s1 is defined as $t1_{min}$; the maximum thickness of the toe part of the adherend s1 is defined as $t2_{max}$; and the minimum thickness of the toe part of the adherend s1 is defined as $t2_{min}$, $t1_{max}$ is equal to or greater than $t2_{max}$; $t1_{min}$ is equal to or greater than $t2_{min}$; and t1 is equal to or greater than $t2_{max}$.

Preferably, the adherend is bonded to the head body by the double-stick tape. Preferably, the double-stick tape includes a first adhesive layer, a second adhesive layer, and an intermediate layer provided between the first adhesive layer and the second adhesive layer. Preferably, the intermediate layer includes a fiber layer.

Preferably, the thickness of the double-stick tape is 0.1 mm or greater and 0.4 mm or less.

Preferably, the fiber layer is a nonwoven fabric layer.

Preferably, the thickness t1 is 0.5 mm or greater and 2.5 mm or less.

Preferably, the thickness t2 is 0.2 mm or greater and 1.5 mm or less.

Preferably, a gravity center distance Dg of the head is 25 mm or greater and 45 mm or less.

Preferably, when a maximum thickness of a heel part of the adherend is defined as $t1_{max}$, a straight line connecting a sweet spot and a gravity center of the head with each other crosses a portion with the thickness $t1_{max}$ of the adherend.

According to the second aspect, the difficult separation of the adherend and the vibration absorbing effect can be combined by making the thickness t2 of the toe part smaller than the thickness t1 of the heel part.

DESCRIPTION OF THE PREFERRED EMBODIMENTS

Hereinafter, the present invention will be described in detail according to the preferred embodiments with appropriate references to the accompanying drawings.

Figure 1:
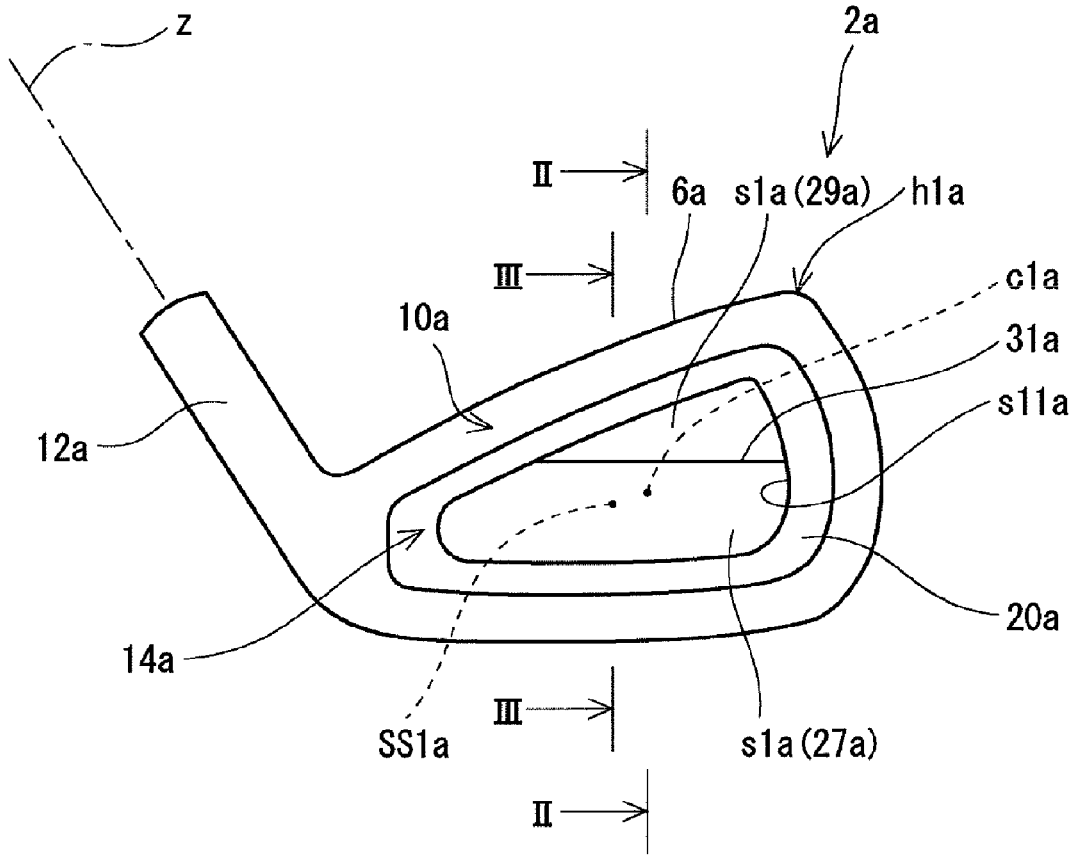
FIG. 1 is a view of a golf club head of a first embodiment of the present invention as seen from a back surface side.
Figure 2:
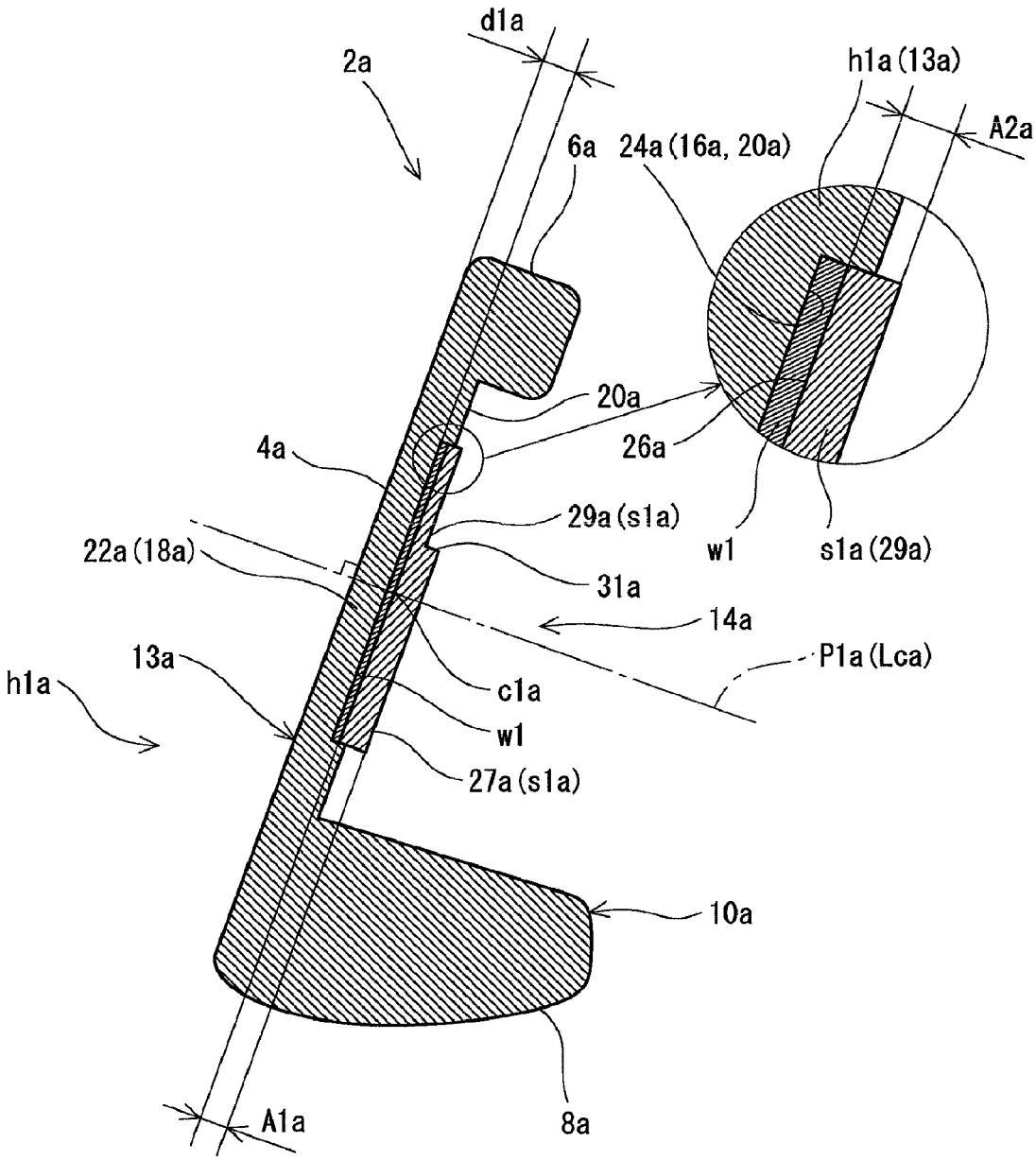
FIG. 2 is a cross sectional view taken along a line II-II in FIG. 1.
Figure 3:
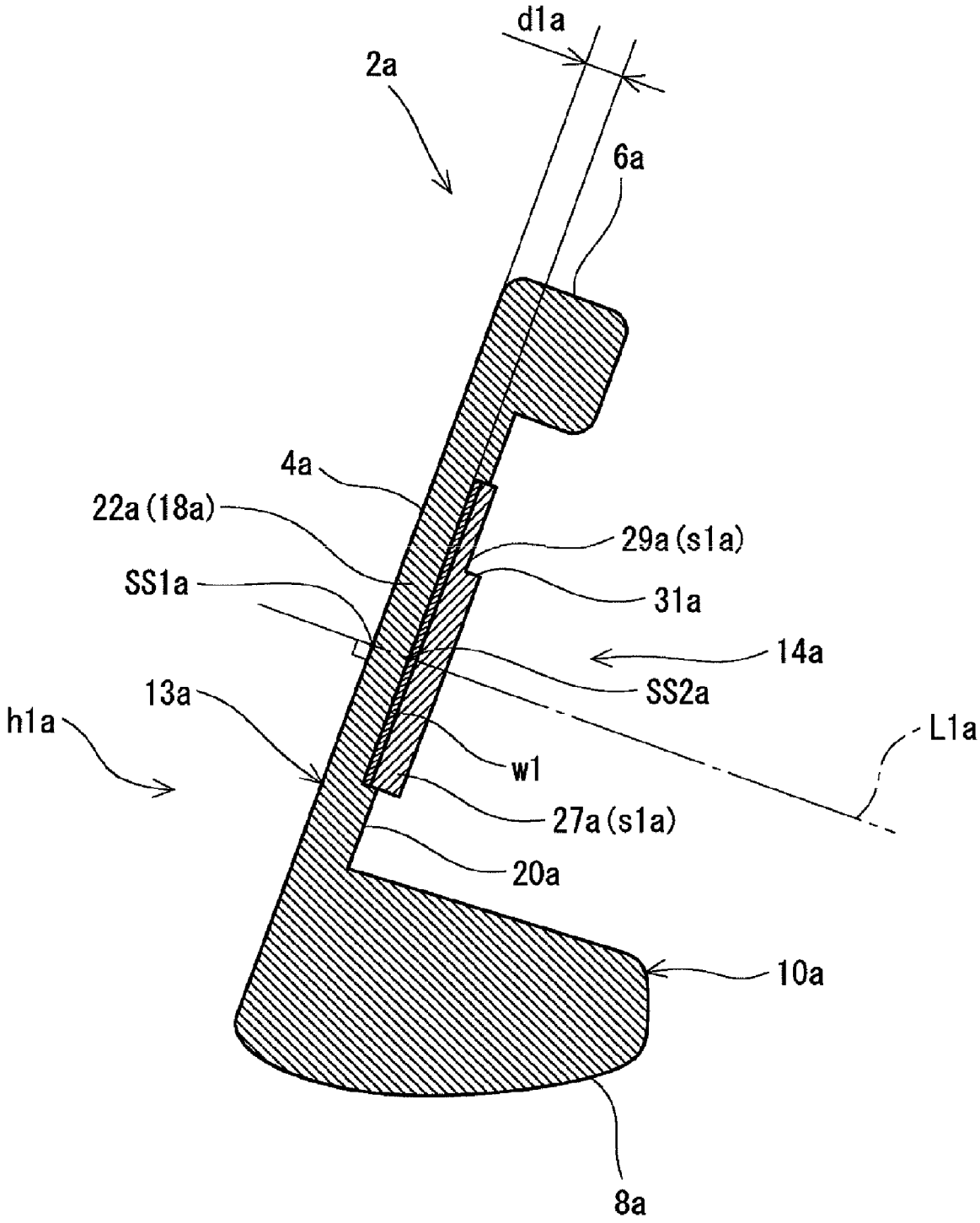
FIG. 3 is a cross sectional view taken along a line III-III in FIG. 1.

FIG. 1 is a view of a golf club head 2*a* of a first embodiment of the present invention as seen from a back surface side. FIG. 2 is a cross sectional view taken along a line II-II in FIG. 1. FIG. 3 is a cross sectional view taken along a line III-III in FIG. 1. The head 2*a* is an iron type golf club head. The head 2*a* has a head body h1*a*, an adherend s1*a*, and a double-stick tape w1. The adherend s1*a* is a thin plate-shaped member. The adherend s1*a* is typically a badge. A metal and a resin are exemplified as the material of the adherend s1*a*. The material of the adherend s1*a* may be a viscoelastic material. Typically, logos and characters which represent product names or the like are indicated on the adherend s1*a*. A profile line s11*a* of the adherend s1*a* is shown in FIG. 1.

The double-stick tape w1 is interposed between the adherend s1*a* and the head body h1*a*. The adherend s1*a* is bonded to the head body h1*a* by the double-stick tape w1. The profile shape of the double-stick tape w1 and the profile shape of the adherend s1*a* are substantially equal.

The shape of the double-stick tape w1 is not limited. A width and a length of the double-stick tape w1 are not limited. The double-stick tape w1 is a sheet having both surfaces having adhesiveness.

The double-stick tape w1 is shown as a single layer in FIG. 2. However, in fact, the double-stick tape w1 is formed of a plurality of layers as described later.

The head body h1*a* has a face part 13*a* provided with a face surface 4*a*, a top surface 6*a*, a sole surface 8*a*, a back surface 10*a*, and a hosel part 12*a*. The face part 13*a* has the face surface 4*a* as an outer surface. The face part 13*a* is solid. A main recessed part 14*a* is formed on the back surface 10*a*. The main recessed part 14*a* is formed on the reverse side of the face surface 4*a*. The head 2*a* having the main recessed part 14*a* is generally referred to as a cavity back iron. The main recessed part 14*a* forms a so-called cavity back. The face part is thinned by the main recessed part 14*a*. A thin wall part (a first thin wall part) 18*a* is formed by the recessed part 14*a*. The thin wall part 18*a* is a part of the face part 13*a*. The thin wall part 18*a* is solid. The adherend s1*a* is stuck on the back surface 10*a* of the head 2*a*. The adherend s1*a* is stuck on the back surface of the thin wall part 18*a*. In other words, the adherend s1*a* is stuck on a bottom surface 20*a* of the main recessed part 14*a*. A front surface of the thin wall part 18*a* is a face surface 4*a*. A back surface of the thin wall part 18*a* is the bottom surface 20*a* of the main recessed part 14*a*.

As shown in FIG. 1 and FIG. 3, a sweet spot SS1*a* of the head 2*a* is located in the thin wall part 18*a*. The sweet spot SS1*a* is a point of intersection between a line passing through the center of gravity of the head 2*a* (not shown) and being perpendicular to the face surface 4*a* and the face surface 4*a*.

In light of the durability, the thickness of the thin wall part 18*a* is preferably equal to or greater than 1.5 mm, and more preferably equal to or greater than 1.8 mm, and still more preferably equal to or greater than 2.0 mm. When the thin wall part 18*a* is thin, the vibration of the face part at the time of hitting a ball is great. When the thin wall part is thin, a great impact force acts on a portion on which the double-stick tape is stuck. Therefore, in this case, the effect of the first aspect may be actualized. From this viewpoint, the thickness of the thin wall part is preferably equal to or less than 3.0 mm, more preferably equal to or less than 2.7 mm, and still more preferably equal to or less than 2.4 mm.

Although illustration is omitted, an impact area marking (not shown) is formed on the face surface 4*a*. The impact area marking is typically a face line (face groove).

A recessed part 16*a* is further formed in the main recessed part 14*a*. The recessed part (a second recessed part) 16*a* is formed on the bottom surface 20*a* of the main recessed part (a first recessed part) 14*a*. The second recessed part 16*a* is shallower than the main recessed part 14*a*. A depth of the recessed part 16*a* is greater than the thickness of the double-stick tape w1. The second recessed part 16*a* accommodates the whole of the double-stick tape w1. The profile shape of the second recessed part 16*a* and the profile shape of the adherend s1*a* are substantially equal.

The face part 13*a* is further thinned by the second recessed part 16*a*. A second thin wall part 22*a* is formed by the second recessed part 16*a*. The second thin wall part 22*a* is a part of the first thin wall part 18*a*. The second thin wall part 22*a* is solid. The adherend s1*a* is stuck on the back surface of the second thin wall part 22*a*. The sweet spot SS1*a* of the head 2*a* is located in the second thin wall part 22*a*. The front surface of the second thin wall part 22*a* is the face surface 4*a*. The back surface of the second thin wall part 22*a* is a bottom surface 24*a* of the second recessed part 16*a*. The bottom surface 24*a* is a part of the bottom surface 20*a*.

The second recessed part 16*a* may not be provided. That is, the whole bottom surface 20*a* of the main recessed part 14*a* may be a plane. In the first aspect, the shape of the bonded surface of the head body h1*a* is not limited.

The adherend s1*a* has an approximately plate shape as a whole. The adherend s1*a* has a bonded surface 26*a*, a thick wall part 27*a*, a thin wall part 29*a* and a bump 31*a*. The bonded surface 26*a* is a plane. The bonded surface 26*a* of the thick wall part 27*a* is the same plane as the bonded surface 26*a* of the thin wall part 29*a*.

The thickness of the thick wall part 27*a* is greater than that of the thin wall part 29*a*. The bump 31*a* is formed by the difference in the thicknesses. The bump 31*a* is a boundary between the thick wall part 27*a* and the thin wall part 29*a*.

The following words are defined in the present application. The average thickness f1 of the lower part of the adherend s1*a* and the average thickness f2 of the upper part of the adherend s1*a* are defined in the first aspect.

[Reference State]

A reference state means a state that a head is placed on a level surface h at a predetermined lie angle and real loft angle. In detail, the reference state means a state where the head is ground on the level surface h with a central axis line z of a shaft hole of the head arranged in an optional vertical plane VP1, the central axis line z tilted at the lie angle relative to the level surface h, and a face surface tilted at the real loft angle relative to the vertical plane VP1. The vertical plane VP1 is a plane which is parallel to a vertical line.

[Gravity Center c1*a* of Profile of Adherend s1*a]*

A profile line s11*a* of the adherend s1*a* is projected on a plane (projection plane) parallel to the face surface 4*a* to obtain a projection image Tz1*a*. The projection is performed in a direction perpendicular to the face surface 4*a*. In the projection plane, the gravity center (centroid) Gc1*a* of the projection image Tz1*a* is determined. A point obtained by projecting the gravity center (centroid) Gc1*a* on the reverse surface (bonded surface 26*a*) of the adherend s1*a* is defined as the gravity center c1*a* of the profile. The projection is performed in a direction perpendicular to the face surface 4*a*.

In the embodiment of FIG. 2, the gravity center c1*a* of the profile is equal to the centroid of the bonded surface 26*a*.

[Reference Line Lca]

A straight line passing through the gravity center c1*a* of the profile and being perpendicular to the face surface 4*a* is defined as a reference line Lca (see FIG. 2).

[Longitudinal Line]

In the head of the reference state, a plane passing through the gravity center of the head (not shown), being perpendicular to the level surface h, and being perpendicular to the vertical plane VP1 is defined as a vertical plane TP. An intersection between the vertical plane TP and the face surface 4*a* is defined as a longitudinal line.

[Boundary Plane P1*a]*

A plane passing through the gravity center c1*a* of the profile, including the reference line Lca, and being perpendicular to the longitudinal line is defined as a boundary plane P1*a*. The boundary plane P1*a* is shown by one straight line (dashed-dotted line) in FIG. 2.

[Average Thickness f1 of Lower Part of Adherend s1*a]*

A part of the head of the reference state below the boundary plane P1*a* is defined as the lower part of the adherend s1*a*, and the average thickness of the lower part is defined as a thickness f1.

[Average Thickness f2 of Upper Part of Adherend s1*a]*

A part of the head of the reference state above the boundary plane P1*a* is defined as the upper part of the adherend s1*a*, and the average thickness of the upper part is defined as a thickness f2.

The face part 13*a* is deformed by a strong impact force caused by hitting. In particular, in the case of a cavity back iron, the deformation is likely to be great.

Since the adherend s1*a* is likely to follow the deformation of the face part 13*a* when the whole adherend s1*a* is thin, the adherend s1*a* is less likely to be separated. However, when the whole adherend s1*a* is thin, the adherend s1*a* is apt to be deformed in the attaching work. Therefore, in this case, the attaching workability is apt to be reduced. When the adherend s1*a* with the tape w1 stuck is deformed, wrinkles and tears may be generated on the tape w1. The wrinkles and tears reduce the adhesive strength.

The adherend s1*a* may have an effect of absorbing vibration generated at the time of hitting the ball. When the whole adherend s1*a* is thin, the vibration absorbing effect is apt to be deteriorated.

On the other hand, when the whole adherend s1*a* is thick, the adherend s1*a* is less likely to follow the deformation of the face part 13*a*. In this case, the separation of the adherend s1*a* is apt to occur.

In the first aspect, the thickness f2 is smaller than the thickness f1. That is, the average thickness of the lower part of the adherend s1*a* is greater than the average thickness of the upper part of the adherend s1*a*. The constitution can provide an adherend s1*a* which is excellent in difficult separation at the time of hitting the ball, an attaching workability, and a vibration absorbing effect.

f2 is set lower than f1 to lower the position of the gravity center of the head. The position of the gravity center can attain a high launch angle and a great flight distance.

In light of enhancing the effects, a ratio (f1/f2) is preferably equal to or greater than 1.1, more preferably equal to or greater than 1.2, and still more preferably equal to or greater than 1.5.

When the ratio (f1/f2) is too great, the thickness f1 may become excessive, and the weight of the adherend s1*a* may become excessive. When the thickness f1 is excessive, the adherend s1*a* is less likely to be deformed and the separation of the adherend s1*a* at the time of hitting the ball is apt to occur. When the thickness f2 is too small, the reduction of the attaching workability and the deterioration of the vibration absorbing effect may occur. From these viewpoints, the ratio (f1/f2) is preferably equal to or less than 5, and more preferably equal to or less than 3.

Thus, the synergistic effect can be attained by providing a relatively thin part and a thick part. In light of further enhancing the synergistic effect, the following relationship 1, 2, 3 or 4 is preferably realized. The following relationships 2 and 4 are more preferably realized. The following relationships 1, 2, 3 and 4 are still more preferably realized. The following relationship 5 is still more preferably realized. The following relationship 6 is particularly preferably realized.

(Relationship 1) $f1_{max}$ is greater than $f2_{max}$.
(Relationship 2) $f1_{min}$ is greater than $f2_{min}$.
(Relationship 3) f1 is greater than $f2_{max}$.
(Relationship 4) $f1_{min}$ is greater than f2.
(Relationship 5) $f1_{min}$ is equal to or greater than $f2_{max}$.
(Relationship 6) $f1_{min}$ is greater than $f2_{max}$.

However, $f1_{max}$ is the maximum thickness of the lower part of the adherend s1*a*; $f1_{min}$ is the minimum thickness of the lower part of the adherend s1*a*; $f2_{max}$ is the maximum thickness of the upper part of the adherend s1*a*; and $f2_{min}$ is the minimum thickness of the upper part of the adherend s1*a*.

In the embodiment, the thickness of the adherend s1*a* is changed in two steps: the thick wall part 27*a*; and the thin wall part 29*a*. However, another aspect is also possible. The thickness of the adherend s1*a* may be changed in three steps or greater. The adherend s1*a* may have a continuously changing part having a thickness continuously (gradually) changed. When the adherend s1*a* has the continuously changing part, the thickness of the continuously changing part is preferably greater as approaching to the sole side of the head. The constitution is likely to set the thickness f1 and the thickness f2 to a preferable range.

As shown in FIG. 1 and FIG. 3, in the embodiment, the existence region of the adherend s1*a* includes a back surface point SS2*a* of a sweet spot SS1*a*. That is, a straight line L1*a* passing through the center of gravity of the head 2*a* and the sweet spot SS1*a* intersects with the adherend s1*a*. The sweet spot SS1*a* is a point of intersection of a perpendicular line led to the face surface 4*a* from the center of gravity of the head 2*a* and the face surface 4*a*. The back surface point SS2*a* is a point of intersection of the straight line L1*a* and the back surface 10*a* of the head body h1*a*. In FIG. 3, the straight line L1*a* is shown by a one-dotted chain line. The point of intersection of the straight line L1*a* and the adherend s1*a* exists on the bonded surface 26*a*. The constitution can effectively absorb the vibration when hitting the ball at the sweet spot SS1*a* or in the vicinity thereof.

In the embodiment, the straight line L1*a* crosses the thick wall part 27*a*. A hitting point (position where the ball is hit) has high probability of being at the sweet spot SS1*a* or in the vicinity thereof. The thick wall part 27*a* may have a vibration absorbing effect more excellent than that of the thin wall part 29*a*. In light of effectively absorbing the vibration generated by hitting the ball, preferably, the straight line L1*a* which connects the sweet spot SS1*a* and the gravity center of the head with each other crosses the thick wall part 27*a*. Preferably, the straight line L1*a* does not cross a part having a thickness of $f2_{min}$. More preferably, the straight line L1*a* crosses a part having a thickness of $f1_{max}$.

Figure 4:
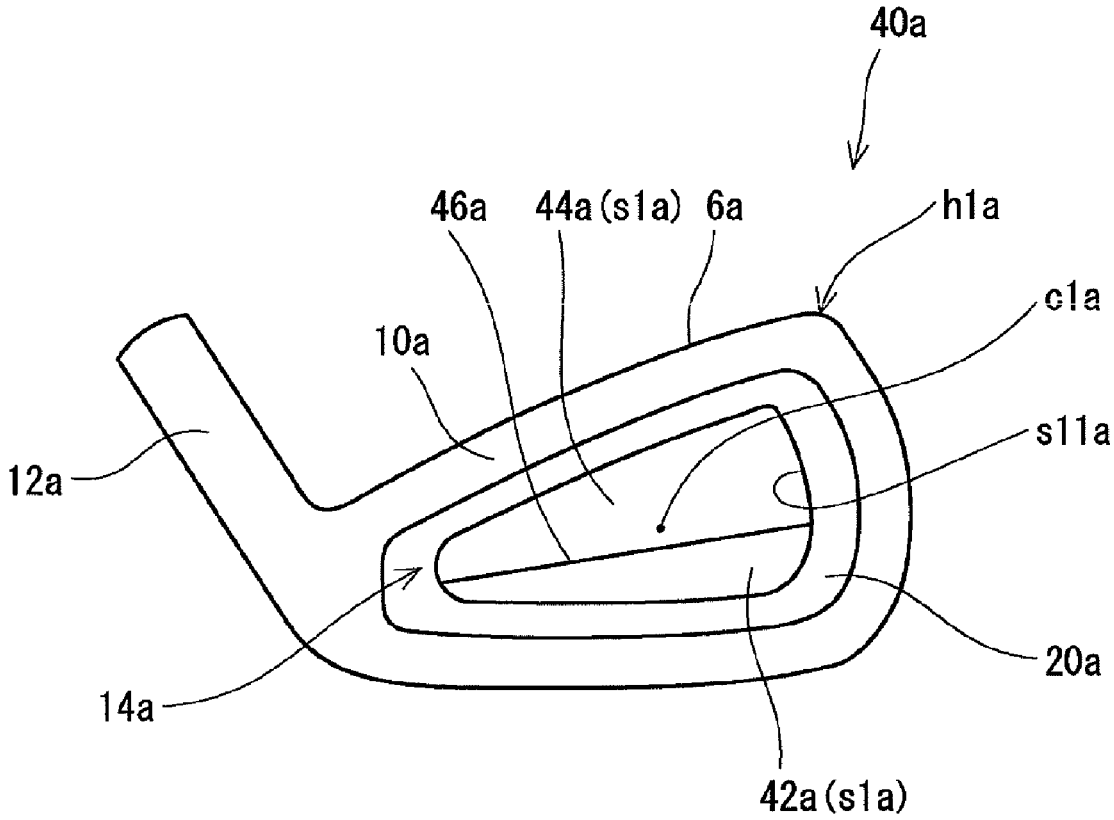
FIG. 4 is a view of a golf club head of a second embodiment of the present invention as seen from a back surface side.

FIG. 4 shows a head 40*a* according to a second embodiment as viewed from a back surface side. FIG. 2 is a cross sectional view taken along a line II-II in FIG. 1. The head 40*a* is the same as the above mentioned head 2*a* except for the wall thickness distribution of the adherend s1*a*. The head 40*a* has a thick wall part 42*a* and a thin wall part 44*a*. A bump 46*a* is a boundary between the thick wall part 42*a* and the thin wall part 44*a*. The bump 46*a* is inclined so as to be nearer to an upper side as approaching to the toe side. In the present invention, an aspect such as the head 40*a* is also possible. In the present invention, the shape and position of the boundary between the thick wall part 42*a* and the thin wall part 44*a* are not limited.

Figure 5:
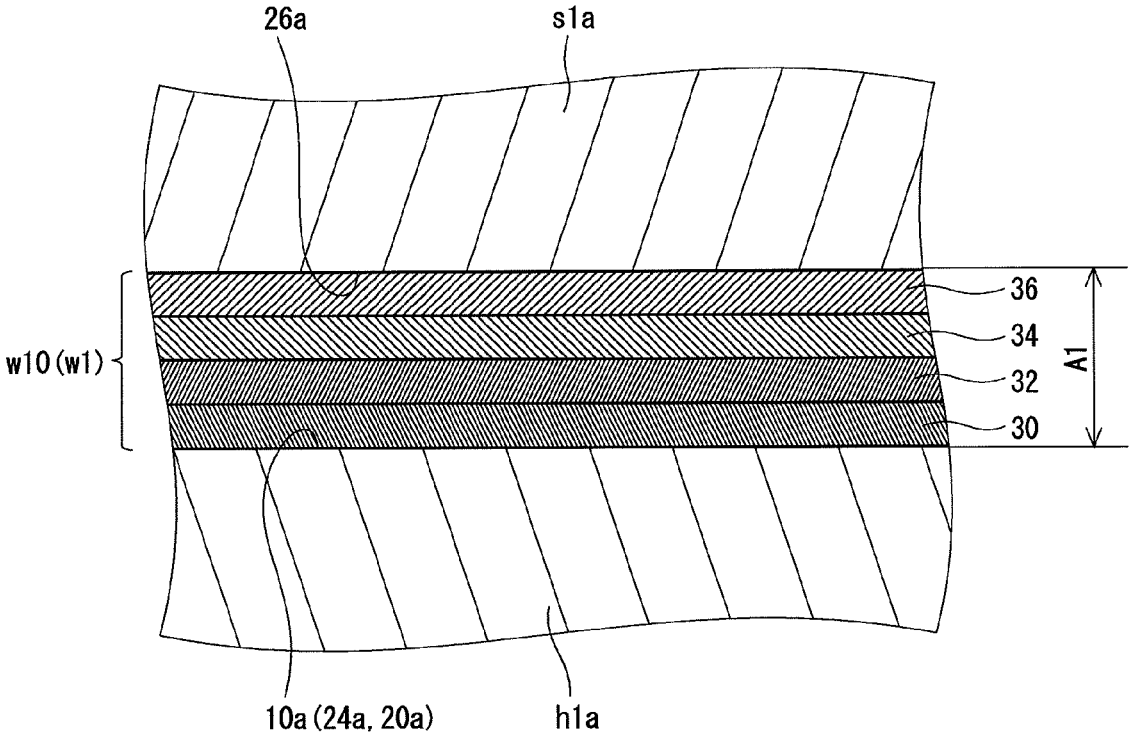
FIG. 5 is an expanded cross sectional view of the vicinity of a double-stick tape.

FIG. 5 is an expanded cross sectional view of the vicinity of the double-stick tape w1. The double-stick tape w1 is a double-stick tape w10 having a four-layered structure. The four layers are a first layer 30, a second layer 32, a third layer 34 and a fourth layer 36 in order from the side of the head body h1*a*. The first layer 30 is an innermost layer of the double-stick tape w10. The first layer 30 is an adhesive layer. The first layer 30 is a first adhesive layer. The second layer 32 and the third layer 34 are intermediate layers. The fourth layer 36 is an adhesive layer. The fourth layer 36 is an outermost layer of the double-stick tape w10. The fourth layer 36 is a second adhesive layer. Although boundaries between the layers are flatly shown in FIG. 5, unevennesses may exist in the boundaries. Particularly, a boundary between the nonwoven fabric layer to be described later and the other layer is usually uneven. The boundaries between the layers may be curved surfaces.

The first adhesive layer 30 abuts on a back surface 10*a* of the head body h1*a*. The second adhesive layer 36 is brought into contact with a bonded surface 26*a* of the adherend s1*a*.

The first layer 30 and the fourth layer 36 are layers made of an adhesive compound. The adhesive compound is not limited. As the adhesive compound, an acrylic adhesive compound, an epoxy adhesive compound, and a urethane adhesive compound or the like are exemplified.

The second layer 32 is a resin layer. The second layer 32 is a resin layer which is free of bubbles. The second layer 32 is an unfoamed resin film. The second layer 32 is not a resin form layer. The kind of a resin forming the second layer 32 is not limited. As a base material resin of the resin layer, an acrylic resin and a polyester resin are exemplified. The acrylic resin is preferable.

The resin layer is apt to be deformed by the existence of bubbles. In light of the durability and the bonding strength, the resin layer which is free of bubbles is preferable.

The third layer 34 is a fiber layer. The third layer 34 is a nonwoven fabric layer. Although not shown in the drawings, a clearance exists in the nonwoven fabric. A part of the adhesive layer 36 adjacent to the third layer 34 enters the clearance. The clearance exists in the nonwoven fabric layer 34. Although not shown in the drawings, a part of the resin layer 32 adjacent to the third layer 34 enters the clearance. Although not shown in the drawings, a part of the adhesive layer 36 adjacent to the third layer 34 enters the clearance of the nonwoven fabric layer 34.

Unlike the embodiment, the second layer 32 may be the fiber layer, and the third layer 34 may be the resin layer.

The nonwoven fabric layer 34 functions as a support of the double-stick tape w10. When the double-stick tape w10 is stuck, wrinkles are less likely to be generated due to the nonwoven fabric layer 34. The nonwoven fabric layer 34 can suppress the bubbles between the bonded surface and the double-stick tape w1.

As described above, one example of the fiber layer is the nonwoven fabric layer. However, the fiber layer is not limited to the nonwoven fabric layer. The fiber layer is a layer containing a fiber. In the fiber layer, the fiber contributes to the enhancement of tensile strength. The fiber layer can suppress the generation of wrinkles. The fiber layer can suppress the generation of bubbles.

A step of sticking the adherend s1*a* on the head body h1*a* includes, for example, a first step of sticking the double-stick tape w1 on the adherend s1*a*, and a second step of sticking the adherend s1*a* on which the double-stick tape w1 is stuck, on the head body h1*a*. In the first process or second process, wrinkles may be generated on the tape w1. The wrinkles reduce the adhesive strength. The double-stick tape w1 having the fiber layer suppresses the generation of the wrinkles.

As preferable fiber layers, for example, the following items (a), (b), (c) and (d) are exemplified.

(a) A layer containing woven fibers;

(b) A layer in which fibers are not woven but entangled with each other;

(c) A layer in which fibers are not woven but fused each other; and (d) A layer in which fibers are not woven but bonded to each other by an adhesive.

The fiber contained in the fiber layer is not limited. As the fiber, a synthetic fiber, a natural fiber and regenerated fiber are exemplified. As the synthetic fiber, a vinylon fiber, a polyester fiber, a polypropylene fiber, a polyethylene fiber and a nylon fiber are exemplified. As the natural fiber, a pulp fiber and a hemp fiber are exemplified. As the regenerated fiber, rayon is exemplified. In light of the suppression of bubbles, the synthetic fiber is preferable.

As the fiber layer, a woven fabric, a nonwoven fabric and paper are exemplified. In the present application, "paper" means Japanese paper or foreign paper. In the present application, "the nonwoven fabric" is defined as the concept which does not contain the paper.

As the materials of the Japanese paper, Broussonetia kazinoki, Diplomorpha sikokiana and Edgeworthia papyrifera are exemplified. In light of the strength, a fiber length of the Japanese paper is preferably equal to or greater than 3 mm, more preferably equal to or greater than 5 mm, still more preferably equal to or greater than 10 mm, and particularly preferably equal to or greater than 15 mm. A fiber length of the Japanese paper is usually equal to or less than 25 mm. The Japanese paper may be produced by hand-making or machine-making.

The material of the foreign paper is a broadleaf tree or a needle leaf tree. A fiber length of the foreign paper is usually 0.8 mm or greater and less than 5 mm. The foreign paper is obtained by machine-making.

As the nonwoven fabric, a wet nonwoven fabric and a dry nonwoven fabric are exemplified.

The method for producing the nonwoven fabric is not limited. As the method for producing the nonwoven fabric, a thermal bond method, a chemical bond method, a needle punch method, a spunlace method (water flow interlacing method), a stitch bond method and a steam jet method are exemplified. When the polyester fiber or the nylon fiber is used as the fiber, the nonwoven fabric produced by the thermal bond method is preferable in light of the productivity and the strength.

In light of suppressing the generation of the wrinkles or bubbles, the fiber layer is preferably the nonwoven fabric or the Japanese paper. In light of the vibrational absorbability, the nonwoven fabric is more preferable.

Figure 6:
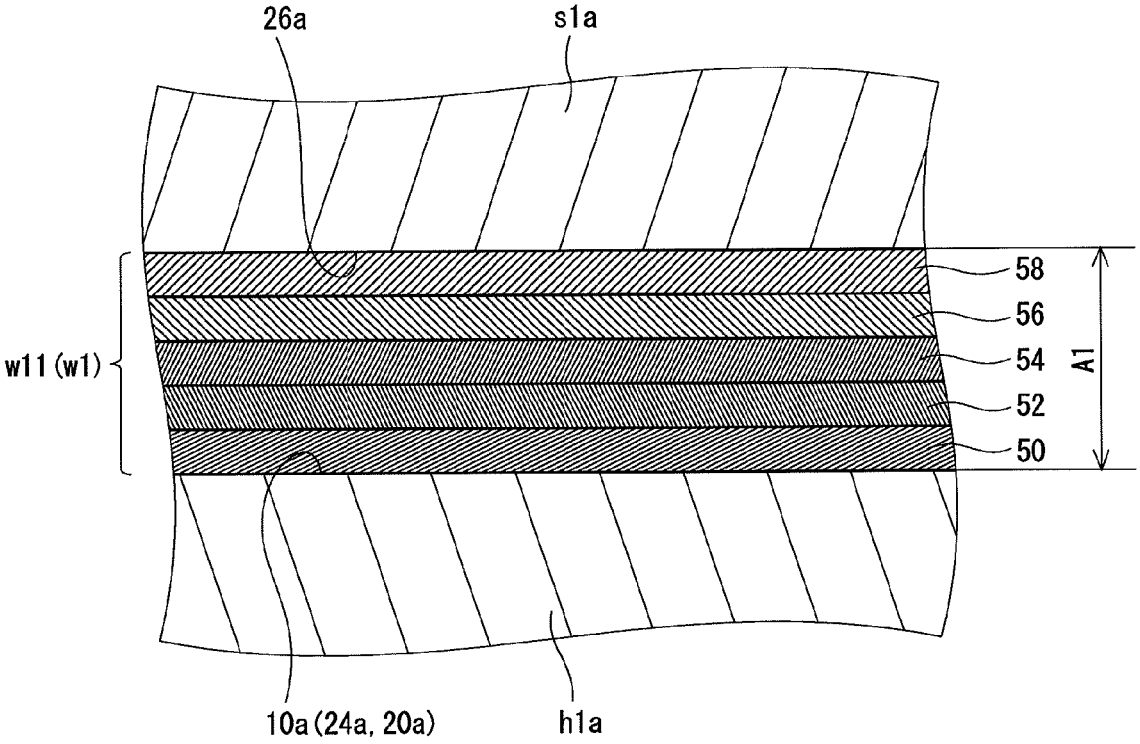
FIG. 6 is an expanded cross sectional view of a double-stick tape of a modification.

FIG. 6 is an expanded cross sectional view showing a double-stick tape w1 in a modification. Although not shown in the drawings, a head body h1*a* and an adherend s1*a* are the same as those of the head 2*a*. In the modification, the double-stick tape w1 is a double-stick tape w11 having a five-layered structure.

The five layers are a first layer 50, a second layer 52, a third layer 54, a fourth layer 56 and a fifth layer 58 in order from the side of the head body h1*a*. The first layer 50 is an innermost layer of the double-stick tape w11. The first layer 50 is an adhesive layer. The first layer 50 is a first adhesive layer. The second layer 52, the third layer 54 and the fourth layer 56 are intermediate layers. The fifth layer 58 is an adhesive layer. The fifth layer 58 is an outermost layer of the double-stick tape t11. The fifth layer 58 is a second adhesive layer. Although boundaries between the layers are flatly shown in FIG. 6, unevennesses may exist in the boundaries.

The first adhesive layer 50 is bonded to the head body h1*a*. The second adhesive layer 58 is bonded to the adherend s1*a*. The adherend s1*a* is bonded to the head body h1*a* by the double-stick tape w11.

The first layer 50 and the fifth layer 58 are layers made of an adhesive compound. The adhesive compound is not limited. As the adhesive compound, an acrylic adhesive compound, an epoxy adhesive compound, and a urethane adhesive compound or the like are exemplified.

The second layer 52 and the fourth layer 56 are resin layers. The second layer 52 and the fourth layer 56 are unfoamed resin films.

The third layer 54 is a fiber layer. Preferably, the fiber layer is a nonwoven fabric or Japanese paper.

Figure 7:
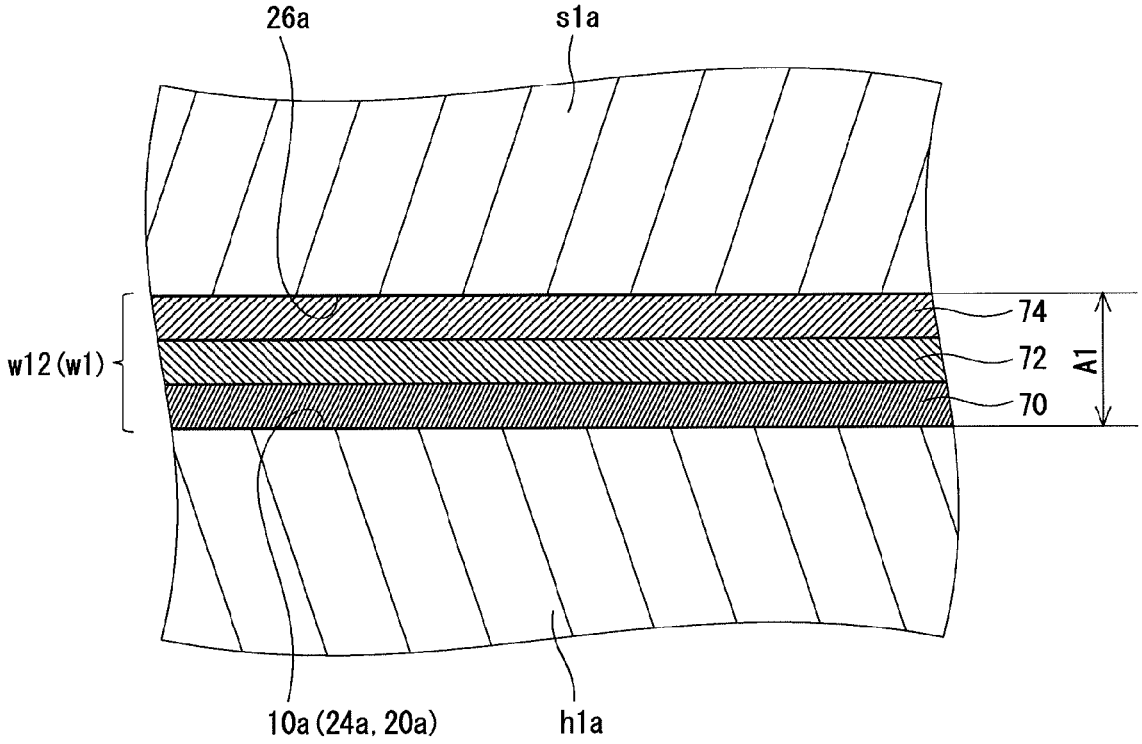
FIG. 7 is an expanded cross sectional view of a double-stick tape of another modification.

FIG. 7 is an expanded cross sectional view showing a double-stick tape w1 in another modification. Although not shown in the drawings, a head body h1*a* and an adherend s1*a* are the same as those of the head 2*a*. In the modification, the double-stick tape w1 is a double-stick tape w12 having a three-layered structure.

The three layers are a first layer 70, a second layer 72 and a third layer 74 in order from the side of the head body h1*a*. The first layer 70 is an innermost layer of the double-stick tape w12. The first layer 70 is an adhesive layer. The first layer 70 is a first adhesive layer. The second layer 72 is an intermediate layer. The third layer 74 is an adhesive layer. The third layer 74 is an outermost layer of the double-stick tape w12. The third layer 74 is a second adhesive layer.

The first adhesive layer 70 is bonded to the head body h1*a*. The second adhesive layer 74 is bonded to the adherend s1*a*. The adherend s1*a* is bonded to the head body h1*a* by the double-stick tape w12.

The second layer 72 is a resin layer. The second layer 72 is an unfoamed resin film.

In the present invention, the double-stick tape w1 which is free of the fiber layer can be also used. However, as described above, the double-stick tape w1 having the fiber layer is preferable.

Figure 8:
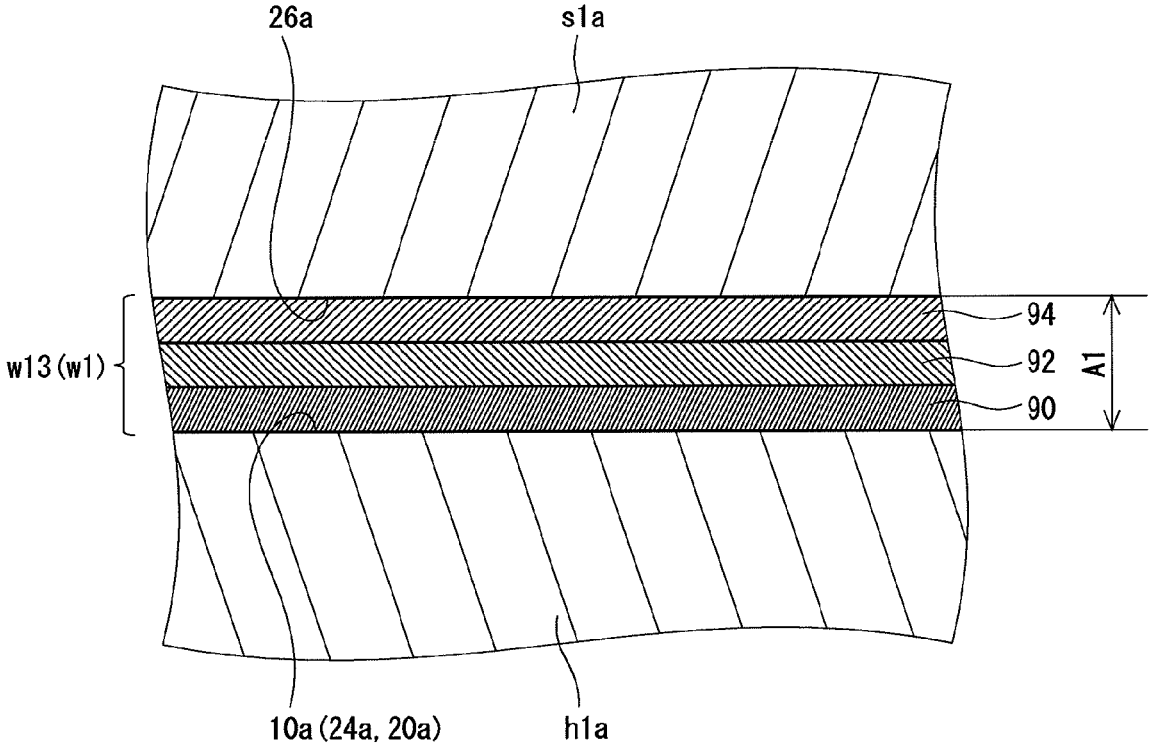
FIG. 8 is an expanded cross sectional view of a double-stick tape of another modification.

FIG. 8 is an expanded cross sectional view showing a double-stick tape w1 in another modification. Although not shown in the drawings, a head body h1*a* and an adherend s1*a* are the same as those of the head 2*a*. In the modification, the double-stick tape w1 is a double-stick tape w13 having a three-layered structure.

The three layers are a first layer 90, a second layer 92 and a third layer 94 in order from the side of the head body h1*a*. The first layer 90 is an innermost layer of the double-stick tape w13. The first layer 90 is an adhesive layer. The first layer 90 is a first adhesive layer. The second layer 92 is an intermediate layer. The third layer 94 is an adhesive layer.

The first adhesive layer 90 is bonded to the head body h1*a*. The second adhesive layer 94 is bonded to the adherend s1*a*. The adherend s1*a* is bonded to the head body h1*a* by the double-stick tape w11.

The first layer 90 and the third layer 94 are layers made of an adhesive compound. The second layer 92 is a fiber layer. Preferable fiber layer is nonwoven layer or Japanese paper layer. In the present invention, the double-stick tape w1 having the three-layered structure can be also suitably used.

A thickness of the double-stick tape w1 is shown by a double-pointed arrow A1 in FIG. 5 or the like. When the double-stick tape w1 is too thin, the rigidity of the double-stick tape w1 is insufficient, and wrinkles and bubbles are apt to be generated. In light of suppressing the generation of the wrinkles and bubbles, the thickness A1 is preferably equal to or greater than 0.1 mm, and more preferably equal to or greater than 0.2 mm. When the thickness A1 is excessive, the deformation amount of the tape w1 is increased, and the moving distance (amplitude) of the adherend s1*a* accompanying the vibration at the time of hitting the ball is also increased. In this case, the separation of the adherend s1*a* is apt to occur. From this viewpoint, the thickness A1 is preferably equal to or less than 0.4 mm, and more preferably equal to or less than 0.3 mm. Thus, even when the thickness A1 is thinned, the generation of wrinkles is effectively suppressed by providing the fiber layer as the intermediate layer.

The adherend s1*a* is disposed on the back surface 10*a* of the face surface 4*a*. The double-stick tape w1 is disposed between the back surface of the face surface 4*a* and the adherend s1*a*.

A ball impacts the face surface 4*a* directly. When the face surface 4*a* hits the ball, a great impact force acts on the face surface 4*a*. Therefore, when the double-stick tape w1 is disposed on the back surface 10*a* of the face surface 4*a*, the vibration absorbing effect is significantly exhibited.

In the embodiment of FIG. 2, the head body h1*a* between the face surface 4*a* and the double-stick tape w1 is solid. When the head body h1*a* is solid, the impact shock on the face surface 4*a* is likely to be transmitted to the double-stick tape w1. Therefore, in this case, the vibration absorbing effect is significantly exhibited. From this viewpoint, the head body h1*a* between the face surface 4*a* and the double-stick tape w1 is preferably solid.

The material of the adhesive layer is not limited. When the adherend s1*a* is attached to the outer surface of the head, the double-stick tape w1 may be protruded from the outer edge of the adherend s1*a*. The protruded double-stick tape w1 is exposed to the outside. The protruded double-stick tape w1 may be visually recognized. The protruded double-stick tape w1 is preferably inconspicuous. Considering the case where double-stick tape w1 is exposed to the outside, it is preferable that the adhesive layer has transparency and weatherability. From this viewpoint, the material of the adhesive layer is preferably the acrylic adhesive compound.

The material of the resin layer which is free of bubbles is not limited. As described above, the double-stick tape w1 may be exposed to the outside. Considering the case where double-stick tape t1 is exposed to the outside, it is preferable that the resin layer which is free of bubbles has transparency and weatherability. From this viewpoint, the base material resin of the resin layer which is free of bubbles is preferably the acrylic resin.

When the fiber layer is the nonwoven fabric layer, the material of a nonwoven fabric which constitutes the nonwoven fabric layer is not limited. As the material of the nonwoven fabric, a natural fiber, a synthetic fiber and a regenerated fiber are exemplified. As the synthetic fiber, vinylon, polyester, polypropylene, polyethylene and nylon are exemplified. As the natural fiber, hemp is exemplified. As the regenerated fiber, rayon is exemplified. In light of the weatherability and the strength, the synthetic fiber is preferable, and polyester and nylon are more preferable.

The specific examples of the double-stick tapes which may be used for the present invention include "Y-4625" (trade name), "VHX-802" (trade name), "Y-9448HK" (trade name), "4393" (trade name), "Y-9448HK" (trade name), "Y-9448HKB" (trade name) and "Y-9448SK" (trade name). All of them are produced by the Sumitomo 3M Limited.

The material of the adherend s1*a* is not limited. Examples of the materials of the adherend s1*a* include a metal, a resin and a viscoelastic material. The plurality of materials may be combined.

The material of the head body h1*a* is not limited. As the material of the head body h1*a*, soft iron (low carbon steel having a carbon content of less than 0.3 wt %), CFRP (carbon fiber reinforced plastic), maraging steel, stainless steel, a titanium alloy, an aluminium alloy and a magnesium alloy are exemplified. The whole of the head body h1*a* may be integrally formed, or may be produced by joining a plurality of members. For example, the head body may be produced by combining a flat plate-shaped face member with a face opening member. In this case, as the face member, a titanium alloy is suitable. As the face opening member, stainless steel is suitable. Forging and casting are exemplified as a method for forming the head body or a component thereof.

The material of the face part 13*a* is not limited. As the material of the face part 13*a*, soft iron (low carbon steel having a carbon content of less than 0.3 wt %), stainless steel, a titanium alloy, CFRP (carbon fiber reinforced plastic), maraging steel, an aluminium alloy and a magnesium alloy are exemplified.

The adherend s1*a* and the double-stick tape w1 form a composite body. The composite body can exhibit a vibration absorbing effect. When the weight of the double-stick tape w1 is too small, the vibration absorbing effect of the composite body deteriorates. From this viewpoint, the weight of the double-stick tape w1 is preferably equal to or greater than 0.1 g, and more preferably equal to or greater than 0.2 g. In light of the weight saving, the weight of the double-stick tape w1 is preferably equal to or less than 2 g, and more preferably equal to or less than 1 g.

In light of vibrational absorbability and hitting feeling, the thickness f1 is preferably equal to or greater than 0.5 mm, more preferably equal to or greater than 0.8 mm, and still more preferably equal to or greater than 1.1 mm. In light of enhancing a followability to the deformation of the head body to suppress the separation, the thickness f1 is preferably equal to or less than 2.0 mm, more preferably equal to or less than 1.7 mm, and still more preferably equal to or less than 1.5 mm.

In light of the vibrational absorbability and the hitting feeling, the thickness f2 is preferably equal to or greater than 0.2 mm, more preferably equal to or greater than 0.3 mm, and still more preferably equal to or greater than 0.5 mm. In light of lowering the gravity center of the head, the thickness f2 is preferably equal to or less than 1.5 mm, more preferably equal to or less than 1.2 mm, and still more preferably equal to or less than 0.9 mm.

The area Sta of the projection image Tz1*a* of the adherend s1*a* is not limited. In light of enhancing the vibrational absorbability when the hitting points vary, the area Sta is preferably equal to or greater than 600 $mm^2$, more preferably equal to or greater than 800 $mm^2$, and still more preferably equal to or greater than 1000 $mm^2$. When the area Sta is too large, the adherend s1*a* is less likely to follow the deformation of the head body, and the separation is apt to occur. From this viewpoint, the area Sta is preferably equal to or less than 1700 $mm^2$, more preferably equal to or less than 1600 $mm^2$, and still more preferably equal to or less than 1500 $mm^2$.

The height Hg of the gravity center of the head is not limited. When the height Hg is too small, a ballistic trajectory of a ball is excessively raised. The excessively raised ballistic trajectory of the ball is apt to be affected by a wind, and the directivity and distance sense of the hit ball is apt to be reduced. From this viewpoint, the height Hg is preferably equal to or greater than 15 mm, more preferably equal to or greater than 17 mm, and still more preferably equal to or greater than 20 mm. In light of a high launch angle increasing a flight distance (particularly, a carry), the height Hg is preferably equal to or less than 30 mm, more preferably equal to or less than 27 mm, and still more preferably equal to or less than 25 mm. The height Hg is a distance between the gravity center of the head and the level surface h in the reference state.

Figure 9:
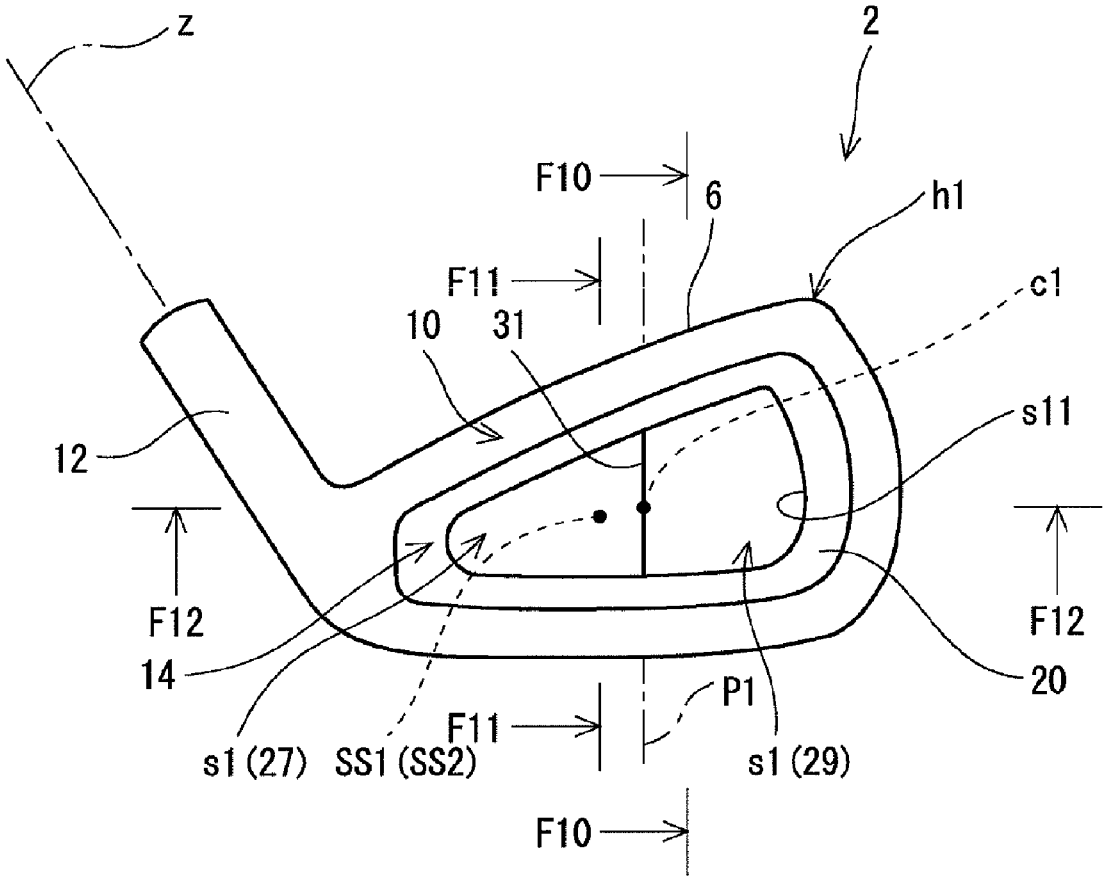
FIG. 9 is a view of a golf club head of a third embodiment of the present invention as seen from a back surface side.
Figure 10:
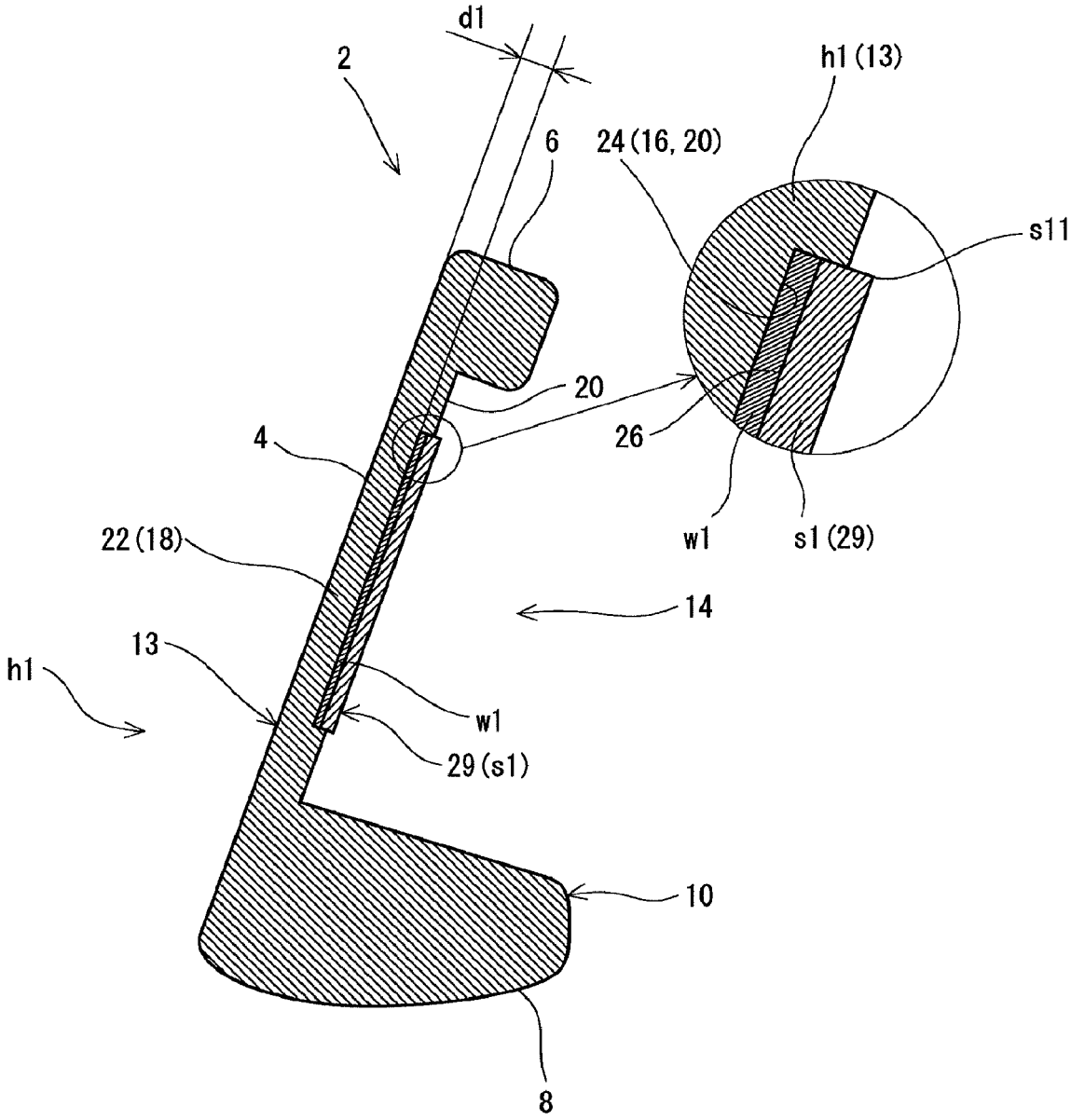
FIG. 10 is a cross sectional view taken along a line F10-F10 in FIG. 9.
Figure 11:
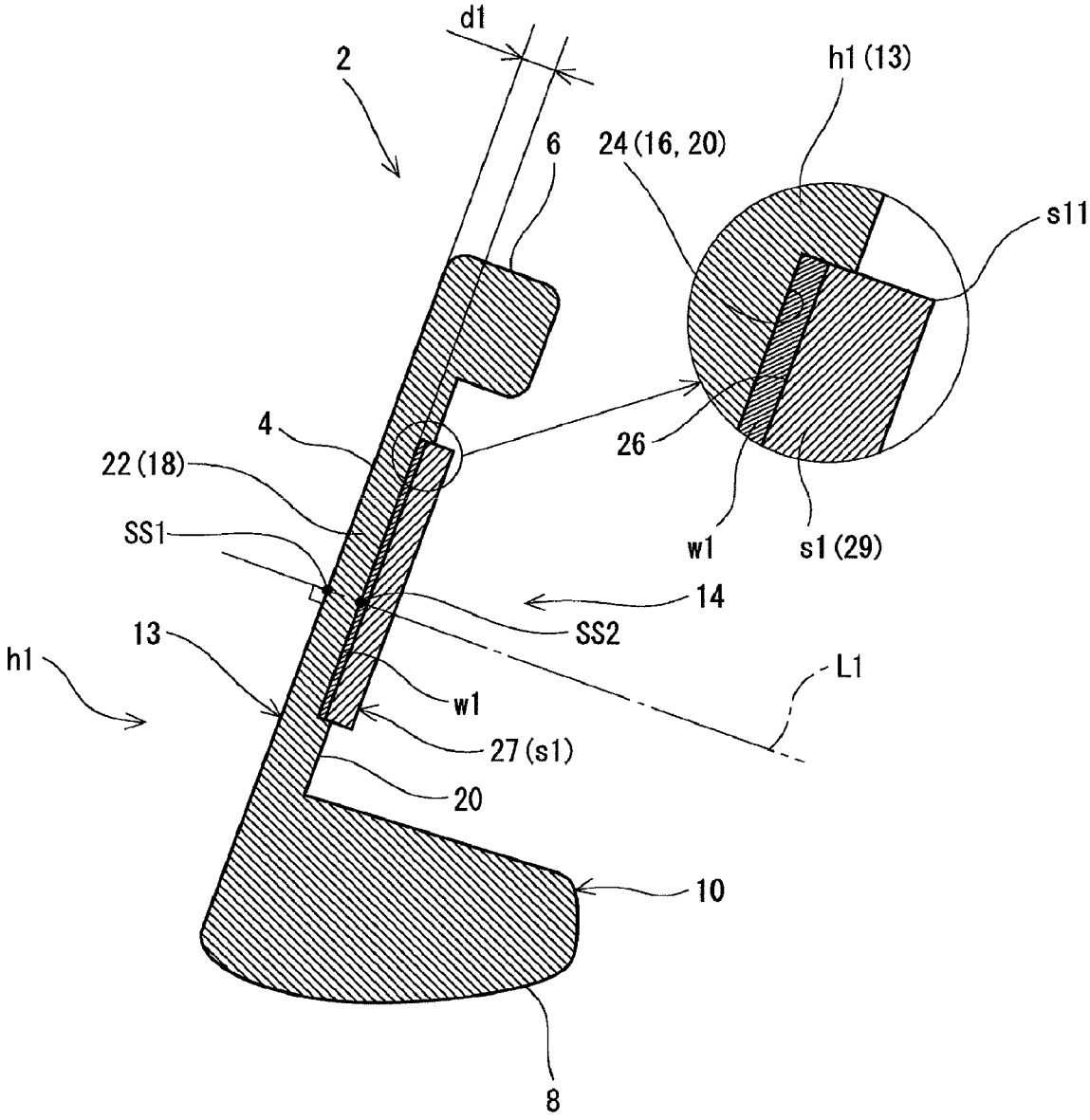
FIG. 11 is a cross sectional view taken along a line F11-F11 in FIG. 9.
Figure 12:
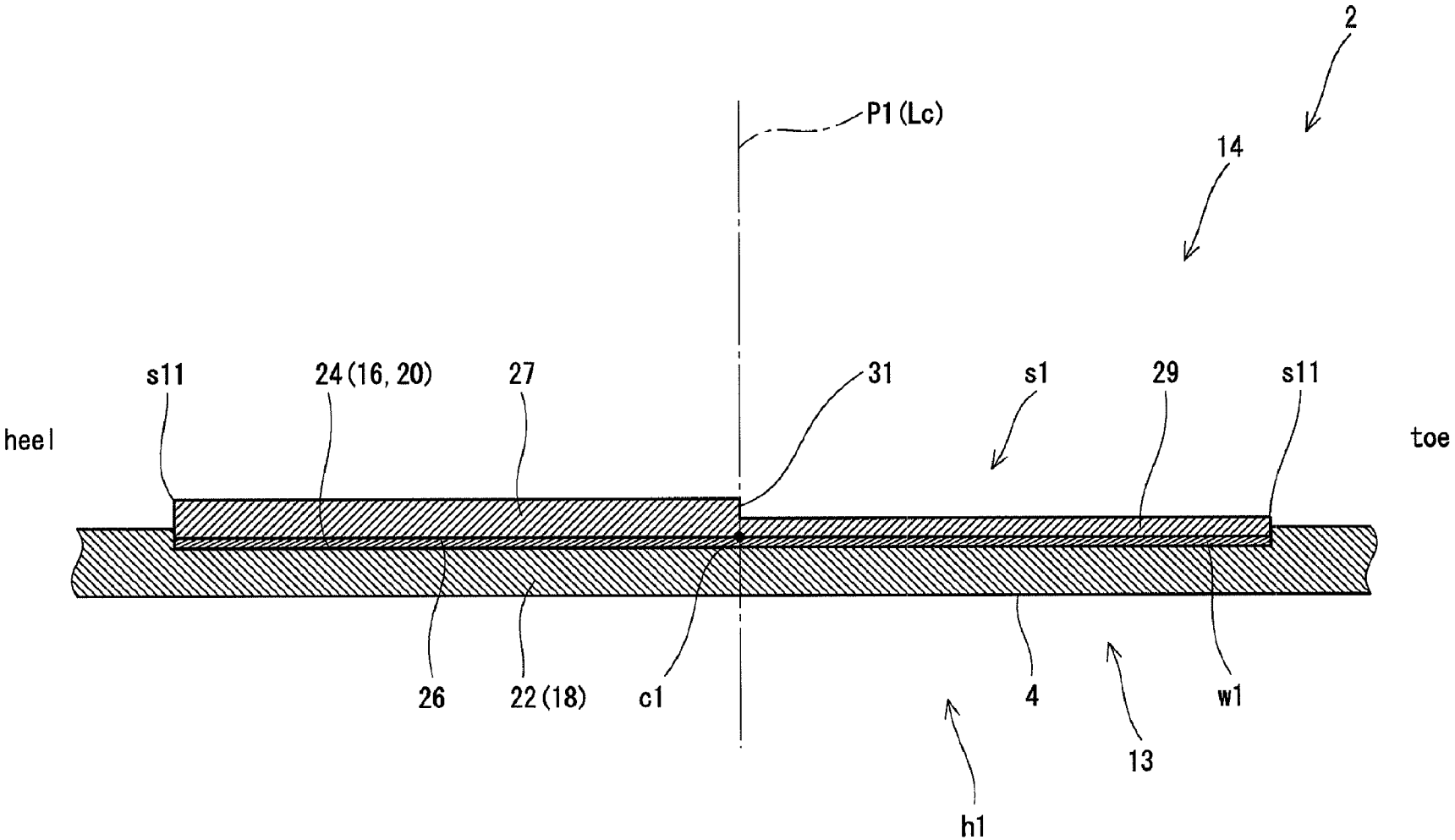
FIG. 12 is a cross sectional view taken along a line F12-F12 in FIG. 9.

FIG. 9 is a view of a golf club head 2 of a third embodiment of the present invention as seen from a back surface side. FIG. 10 is a cross sectional view taken along a line F10-F10 in FIG. 9. FIG. 11 is a cross sectional view taken along a line F11-F11 in FIG. 9. FIG. 12 is a cross sectional view taken along a line F12-F12 in FIG. 9. The head 2 is an iron type golf club head. The head 2 has a head body h1, an adherend s1 and a double-stick tape w1. The adherend s1 is a thin plate-shaped member. The adherend s1 is typically a batch. A metal and a resin are exemplified as the material of the adherend s1. The material of the adherend s1 may be a viscoelastic material. Typically, logos and characters which represent product names or the like are indicated on the adherend s1. A profile line s11 of the adherend s1 is shown in FIG. 9 or the like.

The double-stick tape w1 is interposed between the adherend s1 and the head body h1. The adherend s1 is bonded to the head body h1 by the double-stick tape w1. The profile shape of the double-stick tape w1 and the profile shape of the adherend s1 are substantially equal.

The shape of the double-stick tape w1 is not limited. The width and length of the double-stick tape w1 are not limited. The double-stick tape w1 is a sheet having both surfaces having adhesiveness.

The double-stick tape w1 is shown as a single layer in FIGS. 10, 11 and 12. However, in fact, the double-stick tape w1 is formed of a plurality of layers as described later.

Adhering means is not limited to the double-stick tape w1. For example, an adhesive may be used in place of the double-stick tape w1.

The head body h1 has a face part 13 provided with a face surface 4, a top surface 6, a sole surface 8, a back surface 10 and a hosel part 12. The face part 13 has the face surface 4 as an outer surface. The face part 13 is solid. A recessed part 14 (hereinafter also referred as a main recessed part) is formed on the back surface 10. The main recessed part 14 is formed on the reverse side of the face surface 4. The head 2 having the main recessed part 14 is generally referred to as a cavity back iron. The main recessed part 14 forms a so-called cavity back. The face part is thinned by the main recessed part 14. A thin wall part (a first thin wall part) 18 is formed by the main recessed part 14. The thin wall part 18 is a part of the face part 13. The thin wall part 18 is solid. The adherend s1 is stuck on the back surface 10 of the head 2. The adherend s1 is stuck on the back surface of the thin wall part 18. That is, the adherend s1 is stuck on a bottom surface 20 of the recessed part (main recessed part) 14. The front surface of the thin wall part 18 is the face surface 4. The back surface of the thin wall part 18 is the bottom surface 20 of the main recessed part 14.

As shown in FIGS. 9 and 11, a sweet spot SS1 of the head 2 is located in the thin wall part 18. The sweet spot SS1 is a point of intersection between a line passing through the center of gravity (not shown) of the head 2 and being perpendicular to the face surface 4 and the face surface 4.

In light of the durability, a thickness d1 of the face part 13 on the front side of the adherend s1 is preferably equal to or greater than 1.5 mm, more preferably equal to or greater than 1.8 mm, and still more preferably equal to or greater than 2.0 mm. When the thickness d1 is small, the vibration of the face part at the time of hitting a ball is great. When the thickness d1 is small, a great impact force acts on a portion where the double-stick tape is stuck. Therefore, in this case, the effect of the second aspect may be actualized. From this viewpoint, the thickness d1 is preferably equal to or less than 3.0 mm, more preferably equal to or less than 2.7 mm, and still more preferably equal to or less than 2.4 mm.

Although illustration is omitted, an impact area marking is formed on the face surface 4. The impact area marking is typically a face line (face groove).

A recessed part 16 is further formed in the main recessed part 14. The recessed part (a second recessed part) 16 is formed on the bottom surface 20 of the main recessed part (a first recessed part) 14. The second recessed part 16 is shallower than the main recessed part 14. The depth of the second recessed part 16 is greater than the thickness of the double-stick tape w1. The second recessed part 16 accommodates the whole of the double-stick tape w1. The profile shape of the second recessed part 16 and the profile shape of the adherend s1 are substantially equal.

The face part 13 is further thinned by the second recessed part 16. A second thin wall part 22 is formed by the second recessed part 16. The second thin wall part 22 is a part of the first thin wall part 18. The second thin wall part 22 is solid. The adherend s1 is stuck on the back surface of the second thin wall part 22. The sweet spot SS1 of the head 2 is located in the second thin wall part 22. The front surface of the second thin wall part 22 is the face surface 4. The back surface of the second thin wall part 22 is a bottom surface 24 of the second recessed part 16. The bottom surface 24 is a part of the bottom surface 20.

The second recessed part 16 may not be provided. For example, the whole of the bottom surface 20 of the main recessed part 14 may be a plane. In the present invention, the shape of the bonded surface of the head body h1 is not limited.

The adherend s1 has an approximately plate shape as a whole. The adherend s1 has a bonded surface 26, a thick wall part 27, a thin wall part 29 and a bump 31. The bonded surface 26 is a plane. The bonded surface of the thick wall part 27 is a part of the bonded surface 26. The bonded surface of the thin wall part 29 is a part of the bonded surface 26.

The thickness of the thick wall part 27 is greater than that of the thin wall part 29. The bump 31 is formed by the difference in the thicknesses. The bump 31 is a boundary between the thick wall part 27 and the thin wall part 29.

The following words are defined in the present application. In the second aspect, the average thickness t1 of the heel part of the adherend s1 and the average thickness t2 of the toe part of the adherend s1 are defined.

[Gravity Center c1 of Profile of Adherend s1]

A profile line s11 of the adherend s1 is projected on a plane (projection plane) parallel to the face surface 4 to obtain a projection image Tz1. The projection is performed in a direction perpendicular to the face surface 4. In the projection plane, the gravity center (centroid) Gc1 of the projection image Tz1 is determined. A point obtained by projecting the gravity center (centroid) Gc1 on the reverse surface (bonded surface 26) of the adherend s1 is defined as the gravity center c1 of the profile (see FIGS. 9 and 12). The projection is performed in a direction perpendicular to the face surface 4.

In the head 2, the gravity center c1 of the profile is equal to the centroid of the bonded surface 26.

[Reference Line Lc]

A straight line passing through the gravity center c1 of the profile and being perpendicular to the face surface 4 is defined as a reference line Lc (see FIG. 12).

[Longitudinal Line]

In the head of the reference state, a plane passing through the gravity center of the head (not shown), being perpendicular to the level surface h and being perpendicular to the vertical plane VP1 is defined as a vertical plane TP. The intersection between the vertical plane TP and the face surface 4 is defined as a longitudinal line (not shown).

[Boundary Plane P1]

A plane passing through the gravity center c1 of the profile, including the reference line Lc and being parallel to the longitudinal line is defined as a boundary plane P1. The boundary plane P1 is shown by one straight line (dashed-dotted line) in FIGS. 9 and 12. The plane P1 is perpendicular to the level surface h.

In the embodiment, the bump 31 is in a plane P1. In the present invention, the physical relationship of the bump and the plane P1 is not limited.

[Average Thickness t1 of Heel Part of Adherend s1]

A part of the head of the reference state on the heel side than the boundary plane P1 is defined as a heel part of the adherend s1, and the average thickness of the heel part is defined as a thickness t1.

[Average Thickness t2 of Toe Part of Adherend s1]

A part of the head of the reference state on the toe side than the boundary plane 21 is defined as a toe part of the adherend s1, and the average thickness of the toe part is defined as a thickness t2.

[Toe-Heel Direction]

A direction parallel to the line of intersection between the VP1 and the level surface h in the head of the reference state is defined as a toe-heel direction.

The face part 13 is deformed due to a strong impact force caused by hitting. Since the face part 13 is particularly thin in the case of a cavity back iron, the deformation is likely to be great.

Since the adherend s1 is likely to follow the deformation of the face part 13 when the whole adherend s1 is thin, the adherend s1 is less likely to be separated. However, when the whole adherend s1 is thin, the adherend s1 is apt to be deformed in the attaching work. Therefore, in this case, the attaching workability is apt to be reduced. When the adherend s1 with the tape w1 stuck is deformed, wrinkles and tears may be generated on the tape w1. The wrinkles and tears reduce the adhesive strength.

The adherend s1 may have an effect of absorbing vibration generated at the time of hitting the ball. When the whole adherend s1 is thin, the vibration absorbing effect is apt to be deteriorated.

On the other hand, when the whole adherend s1 is thick, the adherend s1 is less likely to follow the deformation of the face part 13*a*. In this case, the separation of the adherend s1 is apt to occur.

In the second aspect, the thickness t2 is smaller than the thickness t1. That is, the average thickness of the heel part of the adherend s1 is greater than the average thickness of the toe part of the adherend s1. The constitution can provide an adherend s1 which is excellent in a difficult separation at the time of hitting the ball, an attaching workability, and a vibration absorbing effect.

t2 is set lower than t1 to shorten a gravity center distance Dg of the head. The head is likely to be turned upon impact due to the short gravity center distance Dg. The turn of the head suppresses the impact of the face with the face opened. The ball is likely to be caught due to the return of the head. The face is likely to become square upon impact due to the short gravity center distance Dg. Slice is suppressed due to the short gravity center distance Dg. A great flight distance can be obtained by the suppression of the slice. The gravity center distance Dg of the head is a distance (shortest distance) between a shaft axis line z and the gravity center of the head.

The order of the vibration at the time of hitting the ball transmitted to hands is believed to be the order of the following items (1) to (6).

(1) The head impacts the ball, and an impact place (hitting point) vibrates.

(2) The vibration of the hitting point is transmitted to the heel part of the face part.

(3) The vibration of the heel part of the face part is transmitted to the hosel part.

(4) The vibration of the hosel part is transmitted to the shaft.

(5) The vibration of the shaft is transmitted to the grip.

(6) The vibration of the grip is transmitted to the hands.

In the second aspect, since the thickness t1 of the heel part is greater than the thickness t2 of the toe part, the vibration on the heel part side is effectively suppressed. Therefore, the vibration in the item (2) is effectively suppressed and the vibration transmitted by the item (3) can be decreased. That is, in the second aspect, the vibration of the heel part which is the transmission path of the vibration can be suppressed. Therefore, in the second aspect, the vibration (vibration felt by a golf player) transmitted to the hands can be effectively suppressed.

In light of enhancing the effect, a ratio (t1/t2) is preferably equal to or greater than 1.1, more preferably equal to or greater than 1.2, and still more preferably equal to or greater than 1.5. When the thickness t1 is too great, the weight of the adherend s1 becomes excessive. When the thickness t1 is too great, the adherend s1 is less likely to follow the deformation of the head, and the separation of the adherend s1 may be generated. When the average thickness t2 is too small, the workability in attaching may be reduced. When the average thickness t2 is too small, the vibration absorbing effect may be deteriorated. From these viewpoints, a ratio (t1/t2) is preferably equal to or less than 5, and more preferably equal to or less than 3.

Thus, the synergistic effect can be attained by providing a relatively thin part and a thick part. In light of further enhancing the synergistic effect, when the maximum thickness of the heel part of the adherend s1 is defined as $t1_{max}$; the minimum thickness of the heel part of the adherend s1 is defined as $t1_{min}$; the maximum thickness of the toe part of the adherend s1 is defined as $t2_{max}$; and the minimum thickness of the toe part of the adherend s1 is defined as $t2_{min}$, it is preferable that $t1_{max}$ is equal to or greater than $t2_{max}$; $t1_{min}$ is equal to or greater than $t2_{min}$; and t1 is equal to or greater than $t2_{max}$.

In light of further enhancing the synergistic effect, the following relationship 1, 2, 3 or 4 is preferably realized. The following relationships 2 and 4 are more preferably realized. The following relationships 1, 2, 3 and 4 are still more preferably realized. The following relationship 5 is still more preferably realized. The following relationship 6 is particularly preferably realized.

(Relationship 1) $t1_{max}$ is greater than $t2_{max}$.

(Relationship 2) $t1_{min}$ is greater than $t2_{min}$.

(Relationship 3) t1 is greater than $t2_{max}$.

(Relationship 4) $t1_{min}$ is greater than t2.

(Relationship 5) $t1_{min}$ is equal to or greater than $t2_{max}$.

(Relationship 6) $t1_{min}$ is greater than $t2_{max}$.

In the embodiment, the thickness of the adherend s1 is changed in two steps: the thick wall part 27 and the thin wall part 29. However, another aspect is also possible. The thickness of the adherend s1 may be changed in three steps or greater. The adherend s1 may have a continuously changing part having a thickness continuously (gradually) changed. When the adherend s1 has the continuously changing part, the thickness of the continuously changing part is preferably greater as approaching to the heel side of the head. The constitution is likely to set the thickness t1 and the thickness t2 to a preferable range. The whole adherend s1 may be the continuously changing part. The bump 31 may not exist.

As shown in FIGS. 9 and 11, in the embodiment, the existence region of the adherend s1 includes a back surface point SS2 of a sweet spot SS1. That is, a straight line L1 passing through the center of gravity of the head 2 and the sweet spot SS1 intersects with the adherend s1. The sweet spot SS1 is a point of intersection of a perpendicular line led to a face surface 4 from the center of gravity of the head 2 and the face surface 4. The back surface point SS2 is a point of intersection of the straight line L1 and the back surface 10 of the head body h1. In FIG. 11, the straight line L1 is shown by a one-dotted chain line. The point of intersection of the straight line L1 and the adherend s1 exists on the bonded surface 26. The vibration at the time of hitting the ball at the sweet spot SS1 or near sweet spot SS1 can be effectively absorbed by the constitution.

In the embodiment, the straight line L1 crosses the thick wall part 27. When the sweet spot SS1 is a hitting point, the initial speed of the ball is great. A golf player tries to hit the ball to the sweet spot SS1. A probability that the hitting point (position where the ball is hit) is the sweet spot SS1 or near the sweet spot SS1 is high. The thick wall part 27 may have a vibration absorbing effect more excellent than that of the thin wall part 29. In light of effectively absorbing the vibration generated by hitting the ball, preferably, the straight line L1 which connects the sweet spot SS1 and the gravity center of the head with each other crosses the thick wall part 27. Preferably, the straight line L1 does not cross a part having a thickness of $t2_{min}$. More preferably, the straight line L1 crosses a part having a thickness of $t1_{max}$.

Figure 13:
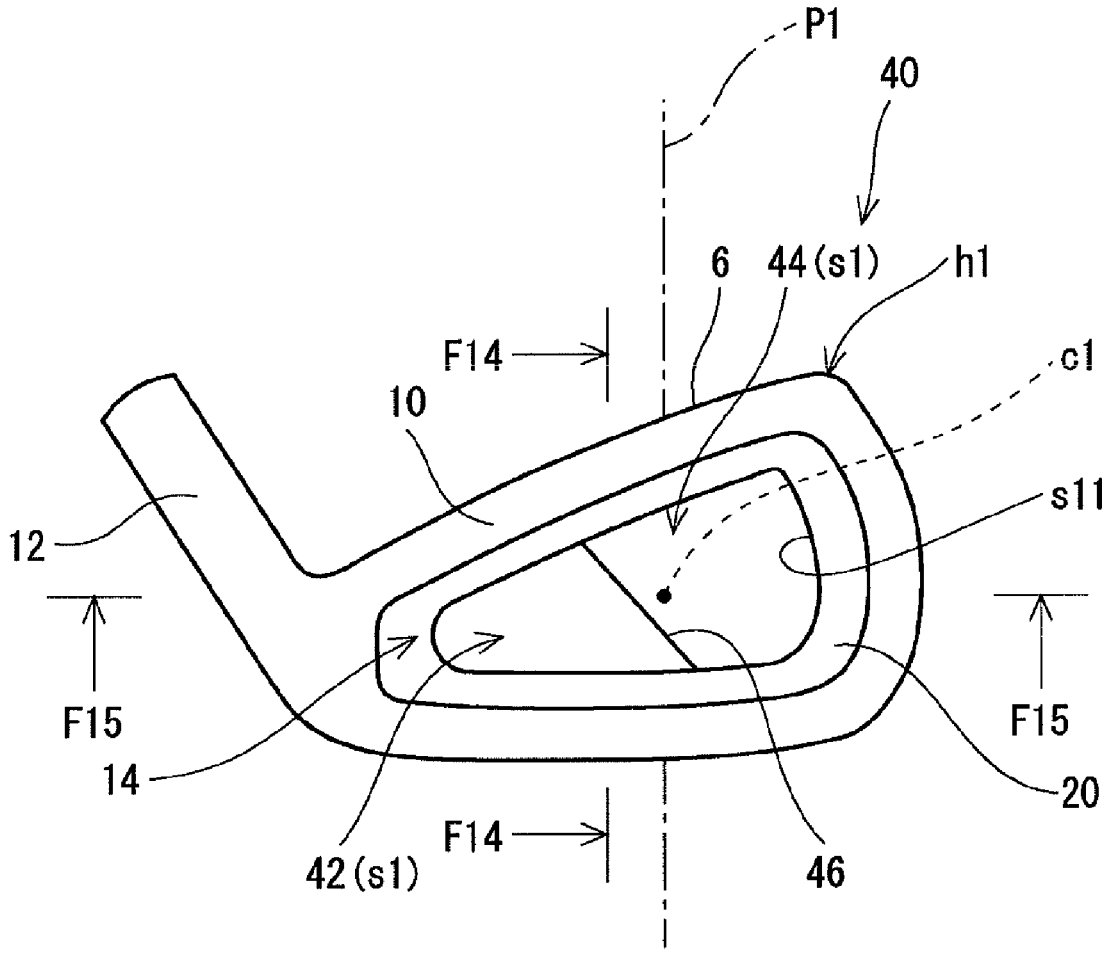
FIG. 13 is a view of a golf club head of a fourth embodiment as seen from a back surface side.
Figure 14:
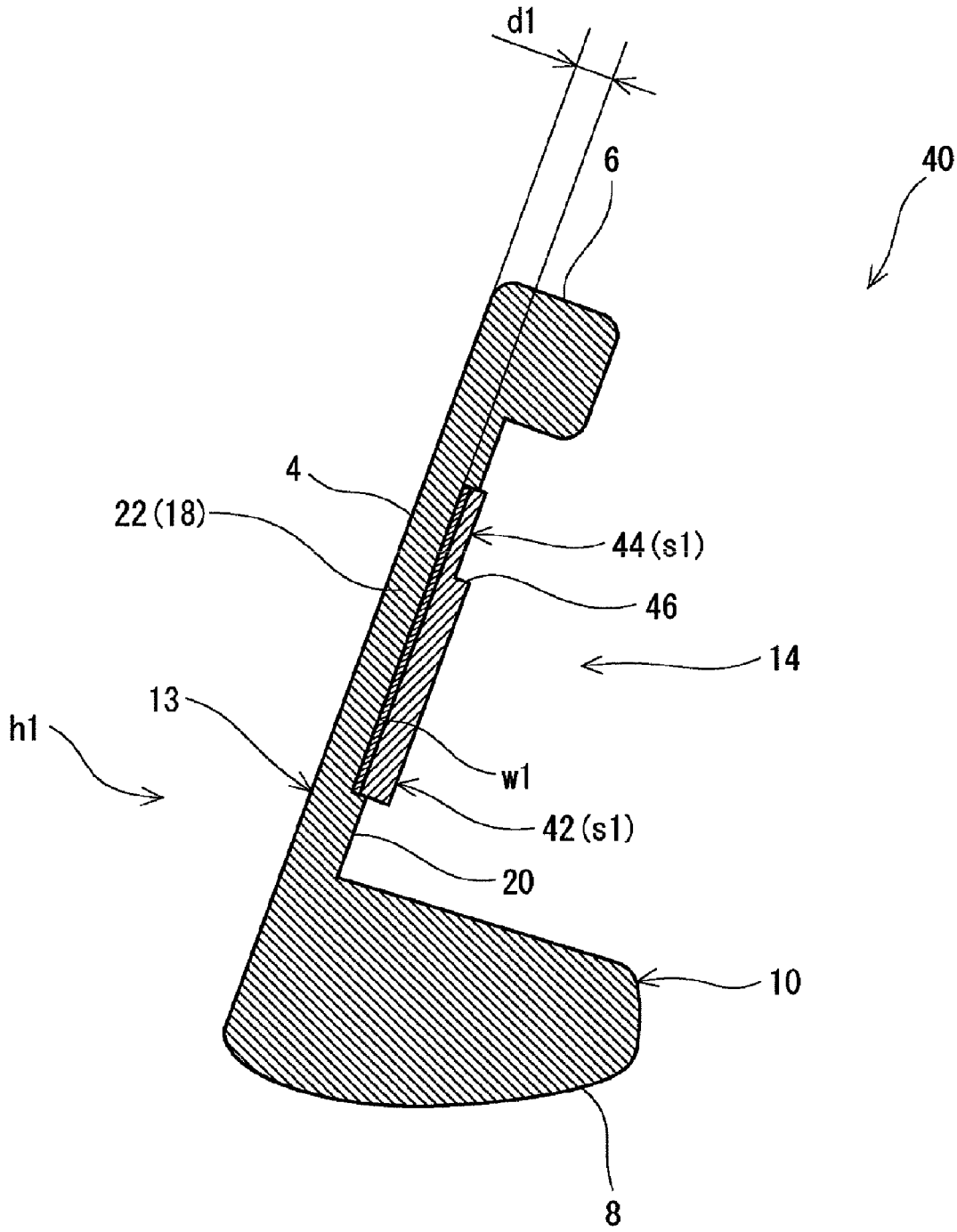
FIG. 14 is a cross sectional view taken along a line F14-F14 in FIG. 13.
Figure 15:
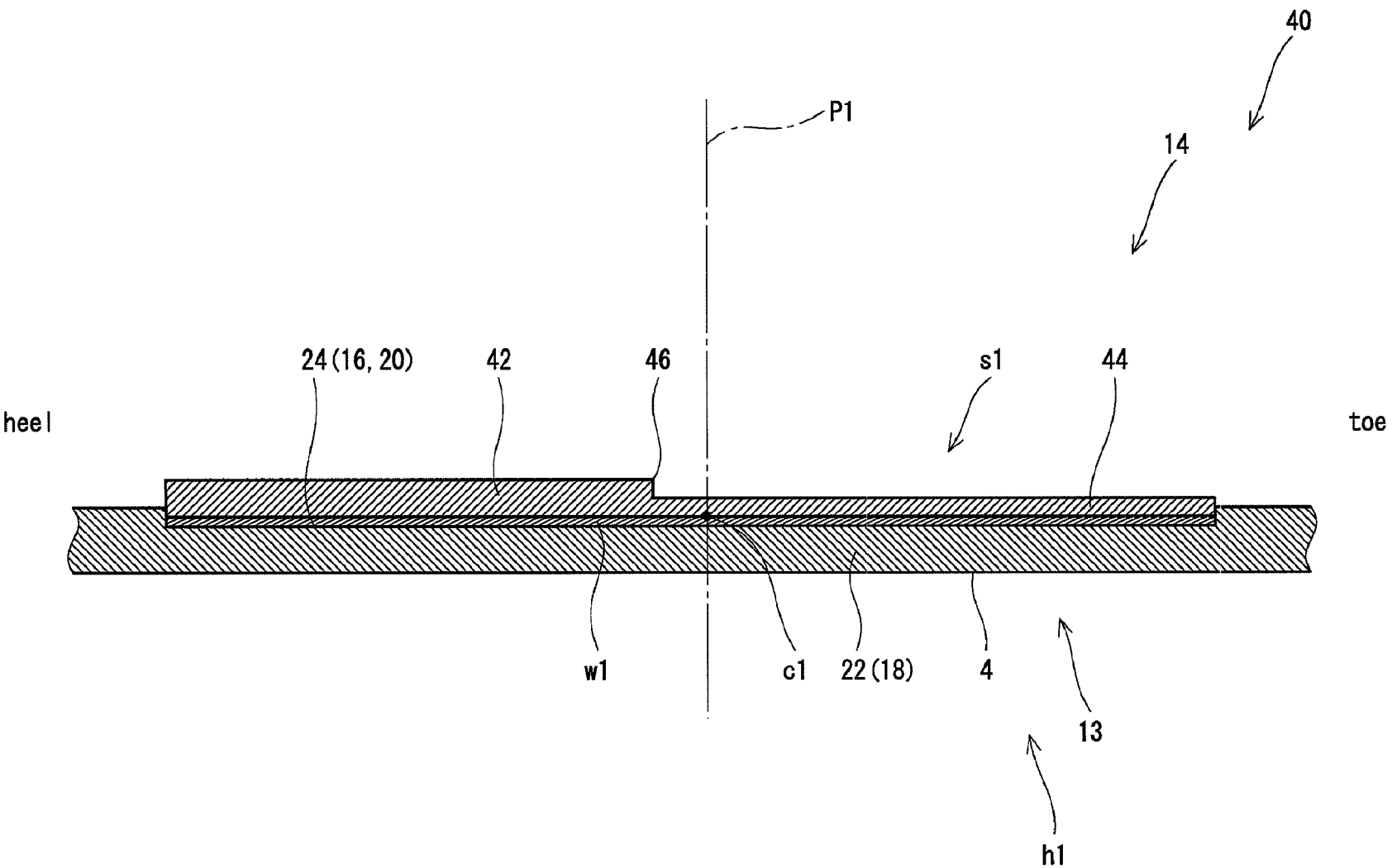
FIG. 15 is a cross sectional view taken along a line F15-F15 in FIG. 13.

FIG. 13 shows a head 40 according to a fourth embodiment as viewed from a back surface side. FIG. 14 is a cross sectional view taken along a line F14-F14 in FIG. 13. FIG. 15 is a cross sectional view taken along a line F15-F15 in FIG. 13. The head 40 is the same as the above mentioned head 2 except for the wall thickness distribution of the adherend s1. The head 40 has a thick wall part 42 and a thin wall part 44. A bump 46 is a boundary between the thick wall part 42 and the thin wall part 44. The bump 46 is inclined so as to be nearer to an upper side as approaching to the heel side. In the head 40, the height of the gravity center can be lowered while the gravity center distance Dg is shortened. In the present invention, for example, an aspect such as the head 40 is also possible. As described above, the shape and position of the boundary between the thick wall part 42 and the thin wall part 44 are not limited. As described above, the bump of the boundary between the thick wall part and the thin wall part may not exist.

Figure 16:
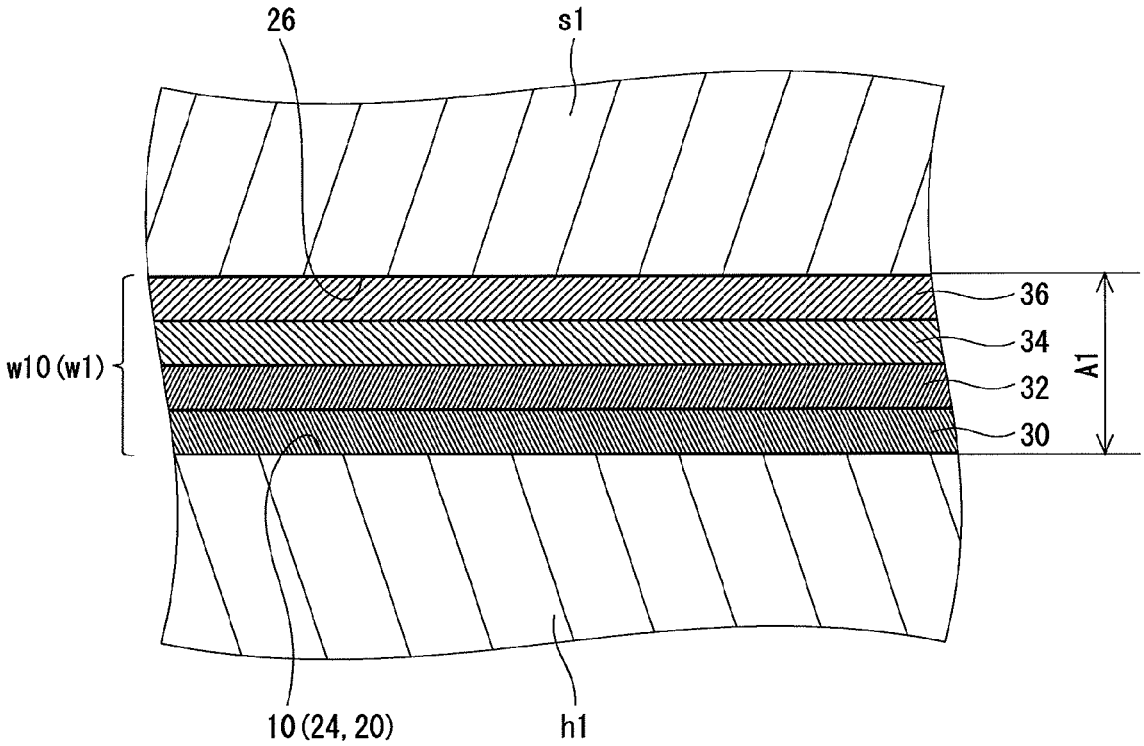
FIG. 16 is an expanded cross sectional view of the vicinity of a double-stick tape.

FIG. 16 is an expanded cross sectional view of the vicinity of the double-stick tape w1. The double-stick tape w1 is a double-stick tape w10 having a four-layered structure. The four layers are a first layer 30, a second layer 32, a third layer 34 and a fourth layer 36 in order from the side of the head body h1. The first layer 30 is an innermost layer of the double-stick tape w10. The first layer 30 is an adhesive layer. The first layer 30 is a first adhesive layer. The second layer 32 and the third layer 34 are intermediate layers. The fourth layer 36 is an adhesive layer. The fourth layer 36 is an outermost layer of the double-stick tape w10. The fourth layer 36 is a second adhesive layer. Although boundaries between the layers are flatly shown in FIG. 16, unevennesses may exist in the boundaries. Particularly, a boundary between a nonwoven fabric layer to be described later and the other layer is usually uneven. The boundaries between the layers may be curved surfaces.

The first adhesive layer 30 is brought into contact with the back surface 10 of the head body h1. The second adhesive layer 36 is brought into contact with the bonded surface 26 of the adherend s1.

The first layer 30 and the fourth layer 36 are layers made of an adhesive compound. The adhesive compound is not limited. As the adhesive compound, an acrylic adhesive compound, an epoxy adhesive compound, and a urethane adhesive compound or the like are exemplified.

The second layer 32 is a resin layer. The second layer 32 is a resin layer which is free of bubbles. The second layer 32 is an unfoamed resin film. The second layer 32 is not a resin form layer. The kind of a resin forming the second layer 32 is not limited. As a base material resin of the resin layer, an acrylic resin and a polyester resin are exemplified. The acrylic resin is preferable.

The resin layer is apt to be deformed by the existence of bubbles. In light of the durability and the bonding strength, the resin layer which is free of bubbles is preferable.

The third layer 34 is a fiber layer. The third layer 34 is a nonwoven fabric layer. Although not shown in the drawing, a clearance exists in the nonwoven fabric. A part of the adhesive layer 36 adjacent to the third layer enters the clearance. The clearance exists in the nonwoven fabric layer 34. Although not shown in the drawing, a part of the resin layer 32 adjacent to the third layer 34 enters the clearance. Although not shown in the drawing, a part of the adhesive layer 36 adjacent to the third layer 34 enters the clearance.

Unlike the embodiment, the second layer 32 may be the fiber layer, and the third layer 34 may be the resin layer.

The nonwoven fabric layer 34 functions as a support of the double-stick tape w10. When the double-stick tape w10 is stuck, wrinkles are less likely to be generated due to the nonwoven fabric layer 34. The nonwoven fabric layer 34 can suppress bubbles between the bonded surface 26 and the tape w1.

As described above, one example of the fiber layer is the nonwoven fabric layer. However, the fiber layer is not limited to the nonwoven fabric layer. The fiber layer is a layer containing a fiber. In the fiber layer, the fiber contributes to the enhancement of tensile strength. The fiber layer can suppress the generation of wrinkles. The fiber layer can suppress the generation of bubbles.

A step of sticking the adherend s1 on the head body h1 includes, for example, a first step of sticking the double-stick tape w1 on the adherend s1, and a second step of sticking the adherend s1 on which the double-stick tape w1 is stuck, on the head body h1. In the first step or the second step, wrinkles are sometimes generated on the tape w1. The wrinkles reduce the bonding strength. The double-stick tape w1 having the fiber layer suppresses the generation of the wrinkles.

As preferable fiber layers, for example, the following items (a), (b), (c) and (d) are exemplified.

(a) A layer containing woven fibers;

(b) A layer in which fibers are not woven but entangled with each other;

(c) A layer in which fibers are not woven but fused to each other; and (d) A layer in which fibers are not woven but bonded to each other by an adhesive.

The fiber contained in the fiber layer is not limited. As the fiber, a synthetic fiber, a natural fiber and regenerated fiber are exemplified. As the synthetic fiber, a vinylon fiber, a polyester fiber, a polypropylene fiber, a polyethylene fiber and a nylon fiber are exemplified. As the natural fiber, a pulp fiber and a hemp fiber are exemplified. As the regenerated fiber, rayon is exemplified. In light of the suppression of bubbles, the synthetic fiber is preferable.

As the fiber layer, a woven fabric, a nonwoven fabric and paper are exemplified. In the present application, "paper" means Japanese paper or foreign paper. In the present application, the "nonwoven fabric" is defined as the concept which does not contain the paper.

As the materials of the Japanese paper, Broussonetica kazinoki, Diplomorpha sikokiana and Edgeworthia papyrifera are exemplified. In light of the strength, the fiber length of the Japanese paper is preferably equal to or greater than 3 mm, more preferably equal to or greater than 5 mm, still more preferably equal to or greater than 10 mm, and particularly preferably equal to or greater than 15 mm. The fiber length of Japanese paper is usually equal to or less than 25 mm. The Japanese paper may be produced by hand-making or machine-making.

The material of the foreign paper is a broadleaf tree or a needle-leaf tree. The fiber length of the foreign paper is usually 0.8 mm or greater and 5 mm or less. The foreign paper is obtained by machine-making.

As the nonwoven fabric, a wet nonwoven fabric and a dry nonwoven fabric are exemplified.

The method for producing the nonwoven fabric is not limited. As the method for producing the nonwoven fabric, a thermal bond method, a chemical bond method, a needle punch method, a spunlace method (water flow interlacing method), a stitch bond method and a steam jet method are exemplified. When a polyester fiber or a nylon fiber is used as the fiber, the nonwoven fabric produced by the thermal bond method is preferable in light of the productivity and the strength.

In light of suppressing the generation of the wrinkles or bubbles, the fiber layer is preferably a nonwoven fabric or Japanese paper. In light of the vibrational absorbability, the nonwoven fabric is more preferable.

Figure 17:
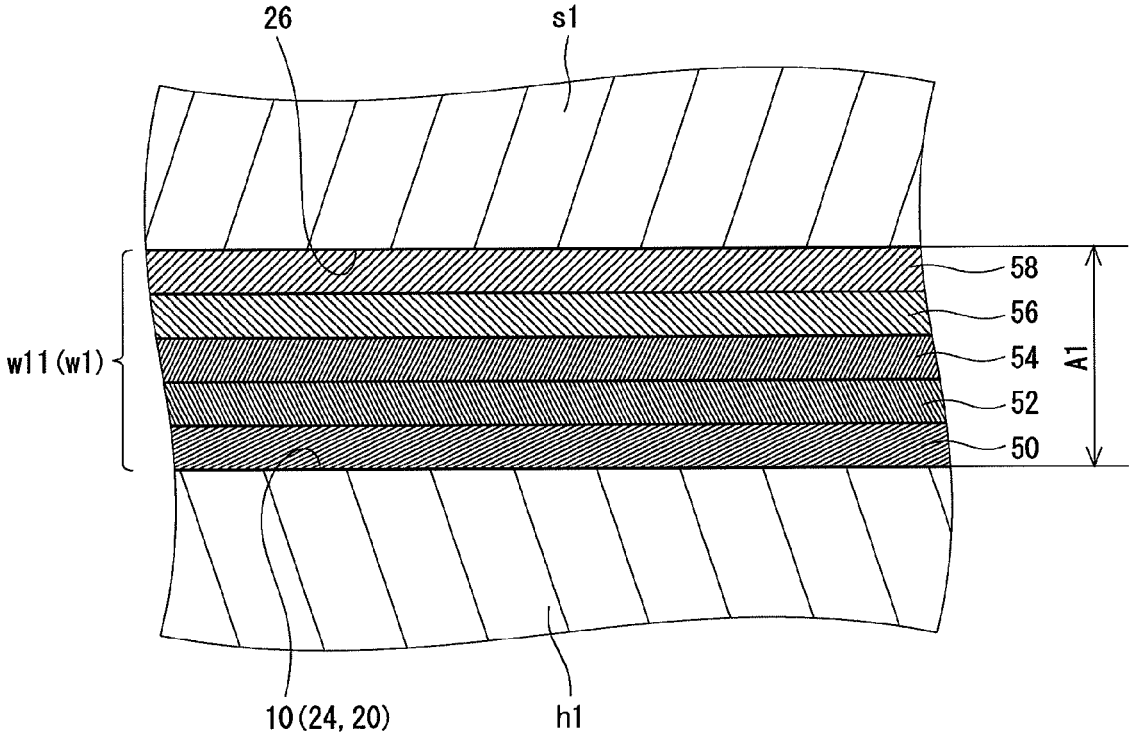
FIG. 17 is an expanded cross sectional view of a double-stick tape of a modification.

FIG. 17 is an expanded cross sectional view showing a double-stick tape w1 in a deformation. Although not shown in the drawing, a head body h1 and an adherend s1 are the same as those of the head 2. In the modification, the double-stick tape w1 is a double-stick tape w11 having a five-layered structure.

The five layers are a first layer 50, a second layer 52, a third layer 54, a fourth layer 56 and a fifth layer 58 in order from the side of the head body h1. The first layer 50 is an innermost layer of the double-stick tape w11. The first layer 50 is an adhesive layer. The first layer 50 is a first adhesive layer. The second layer 52, the third layer 54 and the fourth layer 56 are intermediate layers. The fifth layer 58 is an adhesive layer. The fifth layer 58 is an outermost layer of the double-stick tape w11. The fifth layer 58 is a second adhesive layer. Although boundaries between the layers are flatly shown in FIG. 17, unevennesses may exist in the boundaries.

The first adhesive layer 50 is bonded to the head body h1. The second adhesive layer 58 is bonded to the adherend s1. The adherend s1 is bonded to the head body h1 by the double-stick tape w11.

The first layer 50 and the fifth layer 58 are layers made of an adhesive compound. The adhesive compound is not limited. As the adhesive compound, an acrylic adhesive compound, an epoxy adhesive compound, and a urethane adhesive compound or the like are exemplified.

The second layer 52 and the fourth layer 56 are resin layers. The second layer 52 and the fourth layer 56 are unfoamed resin films.

The third layer 54 is a fiber layer. Preferably, the fiber layer is a nonwoven fabric or Japanese paper.

Figure 18:
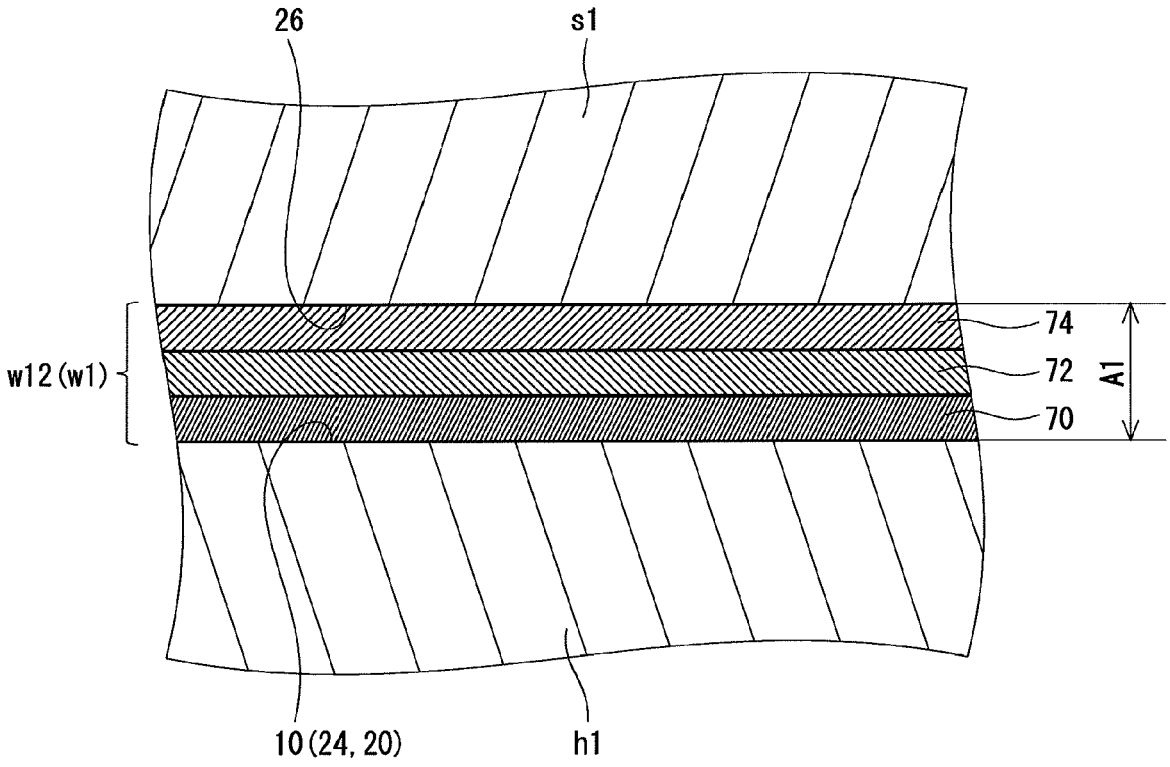
FIG. 18 is an expanded cross sectional view of a double-stick tape of another modification.

FIG. 18 is an expanded cross sectional view showing a double-stick tape w1 in another modification. Although not shown in the drawing, a head body h1 and an adherend s1 are the same as those of the head 2. In the modification, the double-stick tape w1 is a double-stick tape w12 having a three-layered structure.

The three layers are a first layer 70, a second layer 72 and a third layer 74 in order from the side of the head body h1. The first layer 70 is an innermost layer of the double-stick tape w12. The first layer 70 is an adhesive layer. The first layer 70 is a first adhesive layer. The second layer 72 is an intermediate layer. The third layer 74 is an adhesive layer. The third layer 74 is an outermost layer of the double-stick tape w12. The third layer 74 is a second adhesive layer.

The first adhesive layer 70 is bonded to the head body h1. The second adhesive layer 74 is bonded to the adherend s1. The adherend s1 is bonded to the head body h1 by the double-stick tape w12.

The second layer 72 is a resin layer. The second layer 72 is an unfoamed resin film.

Thus, in the present invention, the double-stick tape w1 which does not have the fiber layer can be also used. However, as described above, the double-stick tape w1 having the fiber layer is preferable.

Figure 19:
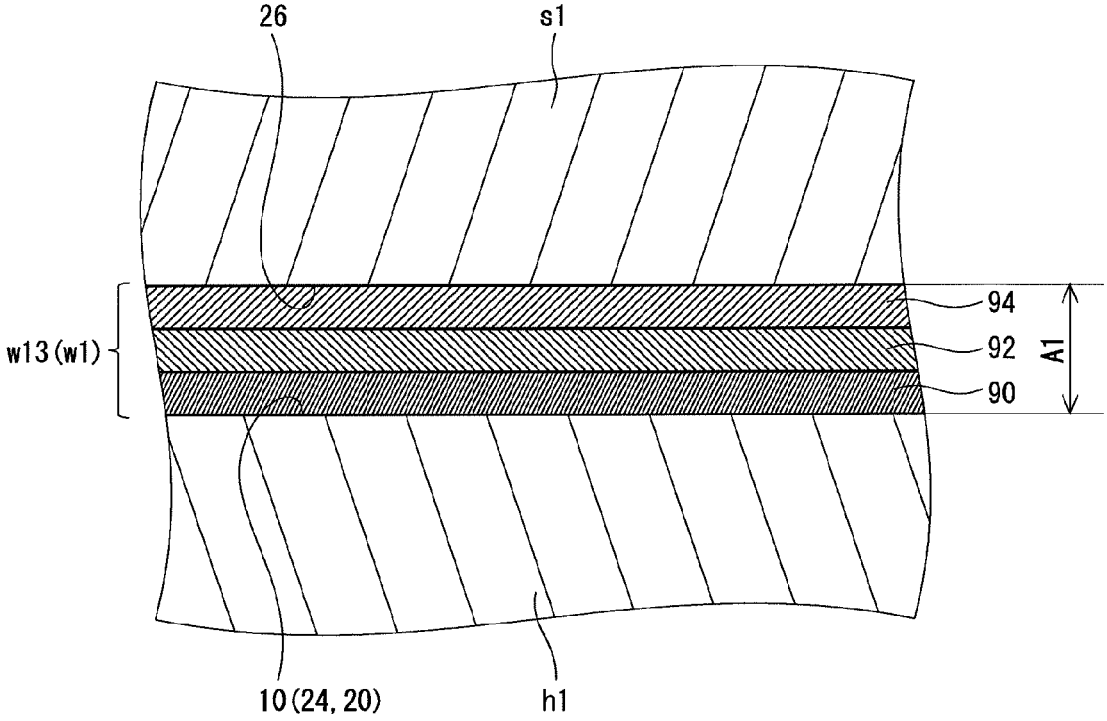
FIG. 19 is an expanded cross sectional view of a double-stick tape of another modification.

FIG. 19 is an expanded cross sectional view showing a double-stick tape w1 in another modification. Although not shown in the drawing, a head body h1 and an adherend s1 are the same as those of the head 2. In the modification, the double-stick tape w1 is a double-stick tape w13 having a three-layered structure.

The three layers are a first layer 90, a second layer 92 and a third layer 94 in order from the side of the head body h1. The first layer 90 is an innermost layer of the double-stick tape w13. The first layer 90 is an adhesive layer. The first layer 90 is a first adhesive layer. The second layer 92 is an intermediate layer. The third layer 94 is an adhesive layer.

The first adhesive layer 90 is bonded to the head body h1. The second adhesive layer 94 is bonded to the adherend s1. The adherend s1 is bonded to the head body h1 by the double-stick tape w11.

The first layer 90 and the third layer 94 are layers made of an adhesive compound. The second layer 92 is a fiber layer. The fiber layer is preferably a nonwoven fabric or Japanese paper. In the present invention, the double-stick tape w1 having the three-layered structure can be also suitably used.

In the present invention, the thickness of the adherend s1 is not uniform. A thin part and a thick part coexist in the adherend s1. A float (clearance) is apt to be caused by the coexistence when the double-stick tape is stuck on the head body. The generation of wrinkles on the double-stick tape may be caused by the float or the like. The wrinkles reduce the adhesive strength. When the double-stick tape having the fiber layer is used as the intermediate layer, the generation of the wrinkles is suppressed.

A thickness of the double-stick tape w1 is shown by a double-pointed arrow A1 in FIG. 16 or the like. When the double-stick tape w1 is too thin, the rigidity of the double-stick tape w1 is insufficient, and wrinkles and air bubbles are apt to be generated. In light of suppressing the generation of the wrinkles and air bubbles, the thickness A1 is preferably equal to or greater than 0.1 mm, and more preferably equal to or greater than 0.2 mm. When the thickness A1 is excessive, the deformation amount of the double-stick tape w1 may increase. Therefore, the moving distance (amplitude) of the adherend s1 accompanying the vibration at the time of hitting the ball may increase. In this case, the separation of the adherend s1 is apt to occur. From this viewpoint, the thickness A1 is preferably equal to or less than 0.4 mm, and more preferably equal to or less than 0.3 mm. Thus, even when the thickness A1 is thinned, the generation of the wrinkles is effectively suppressed by providing the fiber layer as the intermediate layer.

The adherend s1 is disposed on the back surface 10 of the face surface 4. The double-stick tape w1 is disposed between the back surface of the face surface 4 and the adherend s1. A ball impacts the face surface 4 directly. When the ball is hit, a great impact force acts on the face surface 4. Therefore, when the double-stick tape w1 is disposed on the back surface 10 of the face surface 4, the vibration absorbing effect is significantly exhibited.

In the head 2 and the head 40, the head body h1 between the face surface 4 and the double-stick tape w1 is solid. When the head body h1 is solid, the impact shock of the face surface 4 is likely to be transmitted to the double-stick tape w1. Therefore, in this case, the vibration absorbing effect is significantly exhibited. From this viewpoint, the head body h1 between the face surface 4 and the double-stick tape w1 is preferably solid.

The material of the adhesive layer is not limited. When the adherend s1 is attached to the outer surface of the head, the double-stick tape w1 may be protruded from the outer edge of the adherend s1. The protruded double-stick tape w1 is exposed to the outside. The protruded double-stick tape w1 may be visually recognized. The protruded double-stick tape w1 is preferably inconspicuous. Considering the case where the double-stick tape w1 is exposed to the outside, it is preferable that the adhesive layer has transparency and weatherability. From this viewpoint, the material of the adhesive layer is preferably the acrylic adhesive compound.

The material of the resin layer which is free of bubbles is not limited. As described above, the double-stick tape w1 may be exposed to the outside. Considering the case where the double-stick tape w1 is exposed to the outside, it is preferable that the resin layer which is free of bubbles has transparency and weatherability. From this viewpoint, the base material resin of the resin layer which is free of bubbles is preferably the acrylic resin.

When the fiber layer is the nonwoven fabric layer, the material of the nonwoven fabric which constitutes the nonwoven fabric layer is not limited. As the material of the nonwoven fabric, a natural fiber, a synthetic fiber and a regenerated fiber are exemplified. As the synthetic fiber, vinylon, polyester, polypropylene, polyethylene and nylon are exemplified. As the natural fiber, hemp is exemplified. As the regenerated fiber, rayon is exemplified. In light of the weatherability and the strength, the synthetic fiber is preferable, and polyester and nylon are more preferable.

The specific examples of the double-stick tapes which may be used for the present invention include "Y-4625" (trade name), "VHX-802" (trade name), "Y-9448HK" (trade name), "4393" (trade name), "Y-9448HK" (trade name), "Y-9448HKB" (trade name) and "Y-9448SK" (trade name). All of them are produced by the Sumitomo 3M Limited.

The material of the adherend s1 is not limited. Examples of the materials of the adherend s1 include a metal, a resin and a viscoelastic material. The plurality of materials may be combined.

The material of the head body h1 is not limited. As the material of the head body h1, soft iron (low carbon steel having a carbon content of less than 0.3 wt %), CFRP (carbon fiber reinforced plastic), maraging steel, stainless steel, a titanium alloy, an aluminium alloy and a magnesium alloy are exemplified. The whole of the head body h1 may be integrally formed, or the head body h1 may be produced by joining a plurality of members. For example, the head body may be produced by combining a flat plate-shaped face member with a face opening member. In this case, as the face member, a titanium alloy is suitable. As the face opening member, stainless steel is suitable. Forging and casting are exemplified as a method for forming the head body or a component thereof.

The material of the face part 13 is not limited. As the material of the face part 13, soft iron (low carbon steel having a carbon content of less than 0.3 wt %), stainless steel, a titanium alloy, CFRP (carbon fiber reinforced plastic), maraging steel, an aluminium alloy and a magnesium alloy are exemplified.

The adherend s1 and the double-stick tape w1 form a composite body. The composite body can exhibit a vibration absorbing effect. When the weight of the double-stick tape w1 is too small, the vibration absorbing effect of the composite body deteriorates. From this viewpoint, the weight of the double-stick tape w1 is preferably equal to or greater than 0.1 g, and more preferably equal to or greater than 0.2 g. In light of the weight saving, the weight of the double-stick tape w1 is preferably equal to or less than 2 g, and more preferably equal to or less than 1 g.

In light of vibrational absorbability and hitting feeling and of attaining the short gravity center distance Dg, the thickness t1 is preferably equal to or greater than 0.5 mm, more preferably equal to or greater than 0.8 mm, and still more preferably equal to or greater than 1.1 mm. In light of enhancing a followability to the deformation of the head body to suppress the separation, the thickness t1 is preferably equal to or less than 2.5 mm, more preferably equal to or less than 2.2 mm, and still more preferably equal to or less than 1.9 mm.

In light of the vibrational absorbability and the hitting feeling, the thickness t2 is preferably equal to or greater than 0.2 mm, more preferably equal to or greater than 0.3 mm, and still more preferably equal to or greater than 0.5 mm. In light of attaining the short gravity center distance Dg, the thickness t2 is preferably equal to or less than 1.5 mm, more preferably equal to or less than 1.2 mm, and still more preferably equal to or less than 0.9 mm.

The area St of the projection image Tz1 of the adherend s1 is not limited. In light of enhancing the vibrational absorbability when the hitting points vary, the area St is preferably equal to or greater than 800 $mm^2$, more preferably equal to or greater than 1000 $mm^2$, and still more preferably equal to or greater than 1200 $mm^2$. When the area St is too large, the adherend s1 is less likely to follow the deformation of the head body, and the separation is apt to occur. From this viewpoint, the area St is preferably equal to or less than 1900 $mm^2$, more preferably equal to or less than 1800 $mm^2$, and still more preferably equal to or less than 1700 $mm^2$.

The gravity center distance Dg of the head is not limited. In light of suppressing slice, the gravity center distance Dg is preferably equal to or less than 45 mm, more preferably equal to or less than 43 mm, and still more preferably equal to or less than 41 mm. In light of suppressing hook, the gravity center distance Dg is preferably equal to or greater than 25 mm, more preferably equal to or greater than 30 mm, and still more preferably equal to or greater than 35 mm.

EXAMPLES

Hereinafter, the effects of the present invention will be clarified by Examples. However, the present invention should not be interpreted in a limited way based on the description of Examples.

Test 1

For the First Aspect

Example 1a

A head having a shape shown in FIGS. 1, 2 and 3 was produced. However, a head body was formed by joining a face opening member and a flat plate-shaped face member. The joining was carried out by press fitting and caulking. As the material of the face opening member, SUS630 stainless steel was used. As the material of the face member, 6-4 Titanium (Ti-6A1-4V) was used. The face opening member was produced by lost-wax precision casting. The face member was obtained by punching out a plate material and further subjecting the plate material to NC processing. The weight of the face opening member was 175 g. The weight of the face member was 75 g. A batch was used as an adherend s1*a*. The material of the badge was SUS304 stainless steel, and the weight of the badge was 4.5 g. As a double-stick tape, "Y-4625" (trade name) produced by Sumitomo 3M Limited was used. The double-stick tape formed into the same shape as that of the batch was stuck on the batch, and the batch was then stuck on the head body. Then, the batch was pressed to the head body for 10 seconds to obtain the head with the batch. The thickness of "Y-4625" was 0.25 mm. The head was a five-iron. The head was attached to the tip part of a shaft made of CFRP. As the shaft, "MP-400" produced by SRI Sports Limited was used. A grip was attached to the back end part of the shaft to obtain a golf club according to Example 1a. "Y-4625" has a five-layered structure. The five layers are an acrylic adhesive layer, an acrylic resin layer which is free of bubbles, a nonwoven fabric layer, an acrylic resin layer which is free of bubbles and an acrylic adhesive layer in this order from an innermost layer.

In Example 1a, the thickness f1 was set to 1.1 mm, and the thickness f2 was set to 0.9 mm. The thickness of the thick wall part was constant and the thickness of the thin wall part was constant. The specifications and evaluation results of Example 1a are shown in the following Table 1.

Examples 2a and 3a

A golf club head and a golf club of each of Examples were obtained in the same manner as in Example 1a except that the thicknesses of the thick wall part and thin wall part were changed and the thickness f1 and thickness f2 were set to values shown in Table 1. The specifications and evaluation results of Examples 2a and 3a are shown in the following Table 1.

Comparative Example 1a

A golf club head and a golf club of Comparative Example 1a were obtained in the same manner as in Example 1a except that the thickness of a batch was constant (0.5 mm) over the whole batch. The specifications and the evaluation results of Comparative Example 1a are shown in the following Table 1.

Comparative Examples 2a and 3a

A golf club head and a golf club of Comparative Examples 2a and 3a were obtained in the same manner as in Comparative Example 1a except that the thicknesses of batches were set to values shown in Table 1. The specifications and evaluation results of Comparative Examples 2a and 3a are shown in the following Table 1.

[Evaluation of Durability]

Each of the clubs was attached to a swing robot produced by Miyamae Kabushiki Kaisha and made to hit golf balls at a head speed of 54 m/s. As golf balls, "XXIO XD" (trade name) produced by SRI Sports Limited was used. The state of the head was visually observed every 500 hittings, and the state of the bonded surface of the badge was confirmed. The hitting was finished when the separation was confirmed. The evaluation was finished after 5000 times of hitting. The evaluation results are shown in the following Table 1. The durability of Examples and Comparative Examples except for Comparative Example 3a was good.

[Feeling]

Ten testers hit and evaluated impact shock at the time of hitting balls. Five-step evaluation was performed based on the following standard. The higher scores are, the higher the evaluation is. The average value of ten testers' scores is shown in the following Table 1.

Five score: Impact shock is smaller than that of Comparative Example 2a, and hitting feeling is good.

Four score: Impact shock is slightly smaller than that of Comparative Example 2a, and hitting feeling is slightly good.

Three score: Feeling is equivalent to that of Comparative Example 2a.

Two score: Impact shock is slightly greater than that of Comparative Example 2a, and hitting feeling is slightly bad.

One score: Impact shock is greater than that of Comparative Example 2a, and hitting feeling is bad.

[Productivity]

A process for sticking the batch on which the double-stick tape was stuck on the head body was performed. The process was performed for ten heads, and the productivity was evaluated based on sticking easiness and sticking time. The evaluation was performed on the basis of Comparative Example 2a. The evaluation results are shown in the following Table 1.

TABLE 1

Specifications and evaluation results of Examples and Comparative Examples

| | Example 1a | Example 2a | Example 3a | Comparative Example 1a | Comparative Example 2a | Comparative Example 3a |
|---|---|---|---|---|---|---|
| Thickness f1 (mm) | 1.1 | 1.3 | 1.5 | 0.5 | 1.0 | 1.5 |
| Thickness f2 (mm) | 0.9 | 0.7 | 0.5 | 0.5 | 1.0 | 1.5 |
| f1/f2 | 1.2 | 1.9 | 3.0 | 1.0 | 1.0 | 1.0 |
| Durability | There was no separation after 5000 times of hitting | There was no separation after 5000 times of hitting | There was no separation after 5000 times of hitting | There was no separation after 5000 times of hitting | There was no separation after 5000 times of hitting | A part of a bonded surface was separated after 3500 times of hitting |
| Feeling | 3.6 | 4.0 | 4.2 | 2.2 | — | 4.5 |
| Productivity | Equivalent to Comparative Example 2a | Equivalent to Comparative Example 2a | Equivalent to Comparative Example 2a | Worse than Comparative Example 2a | — | Equivalent to Comparative Example 2a |

Test 2

For the Second Aspect

Example 1

A head having a shape shown in FIGS. 9, 10, 11, and 12 was produced. However, a head body was formed by joining a face opening member and a flat plate-shaped face member. The joining was carried out by press fitting and caulking. As the material of the face opening member, SUS630 stainless steel was used. As the material of the face member, 6-4 Titanium (Ti-6A1-4V) was used. The face opening member was produced by lost-wax precision casting. The face member was obtained by punching out a plate material and further subjecting the plate material to NC processing. The weight of the face opening member was 175 g. The weight of the face member was 75 g. A batch was used as an adherend s1. The material of the badge was SUS304 stainless steel, and the weight of the badge was 4.5 g. As a double-stick tape, "Y-4625" (trade name) produced by Sumitomo 3M Limited was used. The double-stick tape formed into the same shape as that of the batch was stuck on the batch, and the batch was stuck on the head body. Then, the batch was pressed to the head body for 10 seconds to obtain the head with the batch. The thickness of "Y-4625" was 0.25 mm. The head was a five-iron. The head was attached to the tip part of a shaft made of CFRP. As the shaft, "MP-400" (trade name) produced by SRI Sports Limited was used. A grip was attached to the back end part of the shaft to obtain a golf club according to Example 1. "Y-4625" has a five-layered structure. The five layers are an acrylic adhesive layer, an acrylic resin layer which is free of bubbles, a nonwoven fabric layer, an acrylic resin layer which is free of bubbles and an acrylic adhesive layer in this order from an innermost layer.

In Example 1, the thickness t1 was set to 1.1 mm, and the thickness t2 was set to 0.9 mm. The thickness of the thick wall part was constant at 1.1 mm, and the thickness of the thin wall part was constant at 0.9 mm. The specifications and evaluation results of Example 1 are shown in the following Table 2.

Examples 2 and 3

A golf club head and a golf club of each of Examples 2 and 3 were obtained in the same manner as in Example 1 except that the thicknesses of the thick wall part and thin wall part were changed and the thickness t1 and thickness t2 were set to values shown in Table 2. The specifications and evaluation results of Examples 2 and 3 are shown in the following Table 2.

Comparative Example 1

A golf club head and a golf club of Comparative Example 1 were obtained in the same manner as in Example 1 except that the thickness of a batch was constant (0.5 mm) over the whole batch. The specifications and evaluation results of Comparative Example 1 are shown in the following Table 2.

Comparative Examples 2 and 3

Golf club heads and golf clubs of Comparative Examples 2 and 3 were obtained in the same manner as in Comparative Example 1 except that the thicknesses of batches (thickness constant over the whole batch) were set to values shown in Table 2. The specifications and evaluation results of Comparative Examples 2 and 3 are shown in the following Table 2.

[Evaluation of Durability]

The evaluation was performed as in the test 1. The evaluation results are shown in the following Table 2. The durability of Examples and Comparative Examples except for Comparative Example 3 was good.

[Feeling]

Ten testers hit and evaluated impact shock at the time of hitting balls. Five-step evaluation was performed based on the following standard. Evaluation was performed on the basis of Comparative Example 2. The higher scores are, the higher the evaluation is. The average value of ten testers' scores is shown in the following Table 2.

Five score: Impact shock is smaller than that of Comparative Example 2, and hitting feeling is good.

Four score: Impact shock is slightly smaller than that of Comparative Example 2, and hitting feeling is slightly good.

Three score: Feeling is equivalent to that of Comparative Example 2.

Two score: Impact shock is slightly greater than that of Comparative Example 2, and hitting feeling is slightly bad.

One score: Impact shock is greater than that of Comparative Example 2, and hitting feeling is bad.

[Productivity]

A process for sticking the batch on which the double-stick tape was stuck on the head body was performed. The process was performed for ten heads, and the productivity was evaluated based on sticking easiness and sticking time. The evaluation was performed on the basis of Comparative Example 2. The evaluation results are shown in the following Table 2.

TABLE 2

Specifications and evaluation results of Examples and Comparative examples

| | Unit | Example 1 | Example 2 | Example 3 | Comparative Example 1 | Comparative example 2 | Comparative Example 3 |
|---|---|---|---|---|---|---|---|
| Thickness t1 | mm | 1.1 | 1.3 | 1.5 | 0.5 | 1.0 | 2.0 |
| Thickness t2 | mm | 0.9 | 0.7 | 0.5 | 0.5 | 1.0 | 2.0 |
| t1/t2 | — | 1.2 | 1.9 | 3.0 | 1.0 | 1.0 | 1.0 |
| Durability | — | Neither separation nor damage were generated after 5000 times of hitting. | Neither separation nor damage were generated after 5000 times of hitting. | Neither separation nor damage were generated after 5000 times of hitting. | Neither separation nor damage were generated after 5000 times of hitting. | Neither separation nor damage were generated after 5000 times of hitting. | A part of a bonded surface of a batch was separated after 3000 times of hitting |
| Feeling | — | 3.5 | 3.9 | 4.4 | 2.2 | — | 4.9 |
| Productivity | — | Equivalent to Comparative Example 2 | Equivalent to Comparative Example 2 | Equivalent to Comparative Example 2 | Worse than Comparative Example 2 | — | Equivalent to Comparative Example 2 |

As described above, Examples have higher evaluation than those of Comparative Examples. Advantages of the present invention are clearly indicated by these results of evaluation.

The present invention also includes an embodiment in which the first aspect and the second aspect were combined. The combined embodiment can synergistically exhibit the effect caused by the first aspect and the effect caused by the second aspect.

The present invention is applicable to all types of golf clubs.

The description hereinabove is merely for an illustrative example, and various modifications can be made in the scope not to depart from the principles of the present invention.

What is claimed is:

1. A golf club head comprising:
a head body;
a double-stick tape; and
an adherend bonded to the head body by the double-stick tape,
wherein the head body has a face surface and a back surface located on a back of the face surface;
the adherend is bonded to the back surface;
an average thickness f2 of an upper part of the adherend is smaller than an average thickness f1 of a lower part of the adherend; and
a ratio (f1/f2) of the thickness f1 to the thickness f2 is 1.1 or greater and 5 or less.

2. The golf club head according to claim 1, wherein an average thickness t2 of a toe part of the adherend is smaller than an average thickness t1 of a heel part of the adherend.

3. The golf club head according to claim 1, wherein the double-stick tape has a first adhesive layer, a second adhesive layer and an intermediate layer provided between the first adhesive layer and the second adhesive layer; and the intermediate layer includes a fiber layer.

4. The golf club head according to claim 3, wherein the fiber layer is a nonwoven fabric layer.

5. The golf club head according to claim 1, wherein a thickness of the double-stick tape is 0.1 mm or greater and 0.4 mm or less.

6. The golf club head according to claim 1, wherein the thickness f1 is 0.5 mm or greater 2.0 mm or less.

7. The golf club head according to claim 1, wherein the thickness f2 is 0.2 mm or greater and 1.5 mm or less.

8. The golf club head according to claim 1, wherein a height Hg of a gravity center of the head is 15 mm.

9. The golf club head according to claim 1, wherein a minimum thickness $f1_{min}$ of a lower part of the adherend is equal to or greater than a maximum thickness $f2_{max}$ of an upper part of the adherend.

10. The golf club head according to claim 1, wherein if a maximum thickness of a lower part of the adherend is defined as $f1_{max}$, a straight line connecting a sweet spot and a gravity center of the head with each other crosses a portion with the thickness $f1_{max}$ of the adherend.

11. A golf club head comprising:
a head body;
a double-stick tape; and
an adherend bonded to the head body by the double-stick tape,
wherein the head body has a face surface and a back surface located on a back of the face surface;
the adherend is bonded to the back surface;
an average thickness t2 of a toe part of the adherend is smaller than an average thickness t1 of a heel part of the adherend; and
a ratio (t1/t2) of the thickness t1 to the thickness t2 is 1.1 or greater and 5 or less.

12. The golf club head according to claim 11, wherein a maximum thickness $t1_{max}$ of the heel part of the adherend is equal to or greater than a maximum thickness $t2_{max}$ of the toe part of the adherend; a minimum thickness $t1_{min}$ of the heel part of the adherend is equal to or greater than a minimum thickness $t2_{min}$ of the toe part of the adherend; and the thickness t1 is equal to or greater than the maximum thickness $t2_{max}$.

13. The golf club head according to claim 11, wherein the adherend is bonded to the head body by a double-stick tape; the double-stick tape has a first adhesive layer, a second adhesive layer and an intermediate layer provided between the first adhesive layer and the second adhesive layer; and the intermediate layer includes a fiber layer.

14. The golf club head according to claim 13, wherein a thickness of the double-stick tape is 0.1 mm or greater and 0.4 mm or less.

15. The golf club head according to claim 13, wherein the fiber layer is a nonwoven fabric layer.

16. The golf club head according to claim 11, wherein the thickness t1 is 0.5 mm or greater and 2.5 mm or less.

17. The golf club head according to claim 11, wherein the thickness t2 is 0.2 mm or greater and 1.5 mm or less.

18. The golf club head according to claim 11, wherein a gravity center distance Dg of the head is 25 mm or greater and 45 mm or less.

19. The golf club head according to claim 11, wherein if a maximum thickness of the heel part of the adherend is defined as $t1_{max}$, a straight line connecting a sweet spot and a gravity center of the head with each other crosses a portion with the thickness $t1_{max}$ of the adherend.

20. A golf club head comprising:
a head body;
a double-stick tape; and
an adherend bonded to the head body by the double-stick tape,
wherein the head body has a face surface and a back surface located on a back of the face surface;
the adherend is bonded to the back surface;
an average thickness f2 of an upper part of the adherend is smaller than an average thickness f1 of a lower part of the adherend; and
the thickness f1 is 0.5 mm or greater 2.0 mm or less.

21. A golf club head comprising:
a head body;
a double-stick tape; and
an adherend bonded to the head body by the double-stick tape,
wherein the head body has a face surface and a back surface located on a back of the face surface;
the adherend is bonded to the back surface;
an average thickness f2 of an upper part of the adherend is smaller than an average thickness f1 of a lower part of the adherend; and
the thickness f2 is 0.2 mm or greater and 1.5 mm or less.

22. A golf club head comprising:
a head body;
a double-stick tape; and
an adherend bonded to the head body by the double-stick tape,
wherein the head body has a face surface and a back surface located on a back of the face surface;
the adherend is bonded to the back surface;

an average thickness f2 of an upper part of the adherend is smaller than an average thickness f1 of a lower part of the adherend; and if a maximum thickness of a lower part of the adherend is defined as $f1_{max}$, a straight line connecting a sweet spot and a gravity center of the head with each other crosses a portion with the thickness $f1_{max}$ of the adherend.

23. A golf club head comprising:

a head body;

a double-stick tape; and an adherend bonded to the head body by the double-stick tape, wherein the head body has a face surface and a back surface located on a back of the face surface;

the adherend is bonded to the back surface;

an average thickness t2 of a toe part of the adherend is smaller than an average thickness t1 of a heel part of the adherend; and a maximum thickness $t1_{max}$ of the heel part of the adherend is equal to or greater than a maximum thickness $t2_{max}$ of the toe part of the adherend; a minimum thickness $t1_{min}$ of the heel part of the adherend is equal to or greater than a minimum thickness $t2_{min}$ of the toe part of the adherend; and the thickness t1 is equal to or greater than the maximum thickness $t2_{max}$.

24. A golf club head comprising:

a head body;

a double-stick tape; and an adherend bonded to the head body by the double-stick tape, wherein the head body has a face surface and a back surface located on a back of the face surface;

the adherend is bonded to the back surface;

an average thickness t2 of a toe part of the adherend is smaller than an average thickness t1 of a heel part of the adherend; and the thickness t1 is 0.5 mm or greater and 2.5 mm or less.

25. A golf club head comprising:

a head body;

a double-stick tape; and an adherend bonded to the head body by the double-stick tape, wherein the head body has a face surface and a back surface located on a back of the face surface;

the adherend is bonded to the back surface;

an average thickness t2 of a toe part of the adherend is smaller than an average thickness t1 of a heel part of the adherend; and the thickness t2 is 0.2 mm or greater and 1.5 mm or less.

26. A golf club head comprising:

a head body;

a double-stick tape; and an adherend bonded to the head body by the double-stick tape, wherein the head body has a face surface and a back surface located on a back of the face surface;

the adherend is bonded to the back surface;

an average thickness t2 of a toe part of the adherend is smaller than an average thickness t1 of a heel part of the adherend; and if a maximum thickness of the heel part of the adherend is defined as $t1_{max}$, a straight line connecting a sweet spot and a gravity center of the head with each other crosses a portion with the thickness $t1_{max}$ of the adherend.

* * * * *